US011060175B2

(12) United States Patent
Christiansen et al.

(10) Patent No.: US 11,060,175 B2
(45) Date of Patent: Jul. 13, 2021

(54) CASE HARDENED COMPONENT OF TITANIUM

(71) Applicant: DANMARKS TEKNISKE UNIVERSITET, Kgs. Lyngby (DK)

(72) Inventors: Thomas Lundin Christiansen, Frederikssund (DK); Morten Stendahl Jellesen, Søborg (DK); Marcel A. J. Somers, Billund (DK); Niklas Brinckman Gammeltoft-Hansen, Valby (DK)

(73) Assignee: DANMARKS TEKNISKE UNIVERSITET, Kgs. Lyngby (DK)

( * ) Notice: Subject to any disclaimer, the term of this patent is extended or adjusted under 35 U.S.C. 154(b) by 134 days.

(21) Appl. No.: 16/306,503

(22) PCT Filed: Jun. 2, 2017

(86) PCT No.: PCT/EP2017/063540
§ 371 (c)(1),
(2) Date: Nov. 30, 2018

(87) PCT Pub. No.: WO2017/207794
PCT Pub. Date: Dec. 7, 2017

(65) Prior Publication Data

US 2019/0292646 A1 Sep. 26, 2019

(30) Foreign Application Priority Data

Jun. 2, 2016 (EP) ..... 16172699

(51) Int. Cl.

| | |
|---|---|
| ***C23C 8/34*** | (2006.01) |
| ***C21D 1/06*** | (2006.01) |
| ***C23C 8/16*** | (2006.01) |
| ***C23C 8/24*** | (2006.01) |

(Continued)

(52) U.S. Cl.
CPC ..... *C23C 8/34* (2013.01); *C21D 1/06* (2013.01); *C23C 8/16* (2013.01); *C23C 8/24* (2013.01);

(Continued)

(58) Field of Classification Search
CPC .... C23C 8/16; C23C 8/34; C23C 8/24; C23C 8/28
See application file for complete search history.

(56) References Cited

U.S. PATENT DOCUMENTS 4,799,977 A 1/1989 Rausch

FOREIGN PATENT DOCUMENTS

| | | |
|---|---|---|
| CN | 101177774 A | 5/2008 |
| EP | 2154263 A1 | 2/2010 |

(Continued)

OTHER PUBLICATIONS

Bailey et al, "Pack carburisation of commercially pure titanium with limited oxygen diffusion for improved tribological properties", Surface & Coating Technology, 2015, 261: 28-34.

(Continued)

*Primary Examiner* — Jessee R Roe
(74) *Attorney, Agent, or Firm* — James S. Keddie; Bozicevic, Field & Francis LLP

(57) ABSTRACT

The present invention relates to a case hardened component of a titanium alloy, the component having a diffusion zone of a thickness of at least 50 μm, as calculated from the surface of the component, the diffusion zone comprising oxygen and carbon in solid solution and having a distinct phase of a carbo-oxide compound having the composition $TiO_xC_{1-x}$, wherein x is a number in the range of 0.01 to 0.99, which diffusion zone has a microhardness of at least 800 HV0.025 and which carbo-oxide compound has a microhardness of at least 1200 HV0.025. In another aspect the (Continued)

invention relates to a method of producing the case hardened component. In a further aspect the invention relates to a method of oxidising a component of a Group IV metal.

10 Claims, 20 Drawing Sheets

(51) Int. Cl.
*C23C 8/28* (2006.01)
*C23C 30/00* (2006.01)
*C23C 8/30* (2006.01)

(52) U.S. Cl.
CPC ..... *C23C 8/28* (2013.01); *C23C 8/30* (2013.01); *C23C 30/005* (2013.01)

(56) References Cited

FOREIGN PATENT DOCUMENTS

| | | | |
|---|---|---|---|
| WO | WO 97/14820 | A1 | 4/1997 |
| WO | WO 03/074752 | A1 | 9/2003 |
| WO | WO 2004/007788 | A1 | 1/2004 |
| WO | WO 2017/207794 | A1 | 12/2017 |

OTHER PUBLICATIONS

Fedirko et al., "Formation of Functional Coatings Based on Interstitial Compounds on Titanium Under the Conditions of Thermodiffusion Saturation", Materials Science, 2006, 42(3): 299-308.
Sarma et al., "Recent Advances in Surface Hardening of Titanium", JOM, 2011, 63(2): 85-92.

CASE HARDENED COMPONENT OF TITANIUM

CROSS-REFERENCE TO RELATED APPLICATIONS

This application is a § 371 national phase of International Application No. PCT/EP2017/063540, filed on Jun. 2, 2017, which claims the benefit of European Patent Application No. 16172699.7, filed on Jun. 2, 2016, which applications are incorporated by reference herein.

FIELD OF THE INVENTION

The present invention relates to a case hardened component of a titanium alloy and to a method of producing the case hardened component. The method provides a surface-adjacent diffusion zone in the titanium alloy, which provides the hardened titanium alloy with resistance to spallation, wear and corrosion as well as a hard surface.

PRIOR ART

Titanium is a light weight metal with a tensile strength comparable to stainless steel, which naturally reacts with oxygen to form a titanium oxide layer on the surface that provides corrosion resistance. These characteristics make titanium highly attractive in many fields, such as aerospace, military and for industrial processes, and moreover since titanium is biocompatible it is also relevant for medical uses, e.g. as implants. Titanium can be alloyed with iron, aluminium, vanadium, molybdenum, and other elements, to modify the characteristics for specific purposes. The naturally forming layer of titanium oxide is thin, e.g. in nanometer scale, and the oxide layer does not provide any mechanical effect. Titanium is relatively soft, e.g. with a hardness less than 500 HV, typically about 200 HV for pure titanium, and it is desirable to case harden the metal in order to improve the surface properties, such as the mechanical performance. In particular, there is an interest in improving the tribological characteristics of titanium and its alloys.

Several examples of case hardening are known from the prior art. For example, WO 2003/074752 discloses a method of case hardening of titanium by nitrogen diffusion and solid solution. The method involves contacting a workpiece of titanium or a titanium alloy with a nitriding gas composed of a nitrogen-containing gas and a carbon-containing gas at a temperature of about 700 to 850° C. for a time sufficient to form a hardened case at least about 5 microns thick and being essentially free of titanium nitride.

WO 2004/007788 discloses a method of case hardening titanium or a titanium-based alloy or zirconium or a zirconium-based alloy, where an article is heat treated for a period of at least 12 hours at a temperature in the range of 850 to 900° C. at a pressure close to atmospheric pressure with a concentration of oxygen in the range of 10 volumes per million to 400 volumes per million. The method was found to harden titanium, but at oxygen concentrations of 500 volumes per million spallation was observed for the treated metal. An additional step of treatment in an atmosphere containing at least 5000 ppm oxygen at 500 to 900° C. led to formation of a visible surface oxide layer.

Similar results were obtained in EP 2154263, which discloses a method of case hardening an article of titanium or a titanium-based alloy where the article is treated at a pressure in the range of 0.5 to 2 bar and a temperature in the range of 750° C. to 870° C. in a diffusion atmosphere comprising i.a. carbon monoxide at a concentration in the range of 20 to 400 volumes per million. A concentration of carbon monoxide above 400 volumes per million was found to result in the formation of an impermeable surface layer that prevented the achievement of an adequate case depth.

Bailey & Sun (Surface & Coatings Technology, 261:28-34, 2015) provide a study of pack carburising surface treatment, whereby oxygen diffusion and carburisation of commercially pure titanium is undertaken. The pack carburisation is carried out with a limited amount of oxygen, at a temperature of 925° C. for 20 hours, which resulted in a multilayer structure comprising a titanium carbide (TiC) network layer atop of a relatively thick α-titanium oxygen diffusion zone (α-Ti(O)). The TiC surface structure was found to have a hardness of about 2100 HV.

Fedirko et al. (Materials Science, 42(3):299-308, 2006) present a review of formation of functional coatings based on interstitial compounds on titanium under the conditions of thermodiffusion saturation. The review summarises how ternary compounds, i.e. of titanium and two of oxygen, nitrogen and carbon are advantageous over binary compounds, i.e. of titanium and one of oxygen, nitrogen and carbon. However, little information is provided about how to achieve such ternary or binary compounds, and the field of hardening titanium is not sufficiently elucidated.

WO 97/14820 discloses a method for treating titanium-containing parts. The method addresses the problem of improving resistance to galling. The method comprises treating the part with a gas containing nitrogen, hydrogen and a carbon oxygen compound at a temperature in the range of 1450° F. to 1850° F. A surface hardness of up to 1300 Hk25 was found for the treated material.

It is an object of the present invention to provide improved methods of case hardening titanium and other titanium alloys, in particular with respect to controlling the properties of the hardened metal.

DISCLOSURE OF THE INVENTION

The present invention relates to a case hardened component of a titanium alloy, the component having a diffusion zone of a thickness of at least 50 μm, as calculated from the surface of the component, the diffusion zone comprising oxygen and carbon in solid solution and having a distinct phase of a carbo-oxide compound having the composition $TiO_xC_{1-x}$, wherein x is a number in the range of 0.01 to 0.99, which diffusion zone has a microhardness of at least 800 $HV_{0.025}$ and which carbo-oxide compound has a microhardness of at least 1200 $HV_{0.025}$.

In a further aspect the invention relates to a method of producing a case hardened component of a titanium alloy, the method comprising the steps of:

- providing a component of a titanium alloy,
- placing the component in a reactive atmosphere comprising a carbon providing gaseous species at a partial pressure of at least $10^{-5}$ bar, the carbon providing gaseous species containing carbon and oxygen, and which reactive atmosphere does not comprise a hydrogen containing species,
- heating the component in an inert atmosphere or the reactive atmosphere to a dissolution temperature $T_D$ of at least 800° C.,
- maintaining the component in the reactive atmosphere at $T_D$ for a reactive duration of at least 30 min to provide the component with a diffusion zone comprising carbon and oxygen in solid solution and having a distinct phase of a carbo-oxide compound having the composition $TiO_xC_{1-x}$, wherein x is a number in the range of 0.01 to 0.99, which diffusion zone has a microhardness of at least 800 $HV_{0.025}$ and which carbo-oxide compound has a microhardness of at least 1200 $HV_{0.025}$, the diffusion zone having a thickness of at least 10 μm, cooling the component from $T_D$ to ambient temperature.

The component is of a titanium alloy, and any titanium alloy, including pure titanium, may be employed. It is however contemplated that the component may be of a Group IV metal, and any Group IV metal is appropriate for the method aspects of the invention. In specific embodiments the Group IV metal is selected from the list of titanium, titanium alloys, zirconium and zirconium alloys. In the context of the invention the component may consist of the titanium alloy, or a Group IV metal, or it may comprise other materials. For example, the component may have a core of another material, a polymer, glass, ceramic or another metal, and an outer layer of the titanium alloy. The outer layer need not completely cover the outer surface of the component. The component may for example be prepared from additive manufacturing or 3D printing prior to be treated in the methods of the invention.

When a titanium alloy is treated in the first method aspect of the invention the surface of the titanium alloy obtains a diffusion zone having a content of carbon in solid solution, e.g. interstitial carbon, and oxygen in solid solution, e.g. interstitial oxygen. The component may also have nitrogen in solid solution, e.g. interstitial nitrogen. In the context of the invention the diffusion zone may also be referred to as a "mixed-interstitial solid solution layer" and throughout this document the two terms may be used interchangeably. The diffusion zone will have a thickness, as calculated from the surface of the titanium alloy of at least 50 μm. The solubility of carbon in titanium is maximally about 0.38% but the present inventors have surprisingly found that when carbon and oxygen are dissolved simultaneously in titanium according to the method of the invention, a higher level of carbon can be dissolved in titanium than when no oxygen is dissolved. Thereby an improved material can be provided than according to methods of the prior art.

Moreover, the simultaneous dissolution of carbon and oxygen allows formation of a distinct phase of carbo-oxide compounds of titanium alloy with carbon and oxygen in the diffusion zone, which in turn provides an extremely hard surface. The carbo-oxide compound may also be referred to as a "mixed-interstitial compound" and the terms may be used interchangeably in this document. The carbo-oxide compound is evident as a distinct phase in the cross-section of the component when observed visually, e.g. using a microscope. Likewise, the diffusion zone can also be differentiated from the core of the material when observed visually. Microhardnesses may be measured for each phase, i.e. the carbo-oxide compound, the diffusion zone, and the core of the material. The distinct phase of the carbo-oxide compound is strongly integrated in the diffusion zone, and the carbo-oxide compound will generally extend from the surface and into the diffusion zone so that the microhardness of the diffusion zone and the microhardness of the carbo-oxide compound may be measured at the same depth from the surface of the component. For example, the microhardnesses of each zone may be measured at a depth from the surface of at least 20 μm. The carbo-oxide compound preferably extends at least 25 μm from the surface and may extend from the surface and to the thickness of the diffusion zone. For example, the carbo-oxide compound may have an extension from the surface in the range of 50 μm to 200 μm.

It is preferred that the diffusion zone does not comprise hydrogen, i.e. interstitial hydrogen. It is generally observed, that if interstitial hydrogen is present in the diffusion zone the microhardness of the diffusion zone is limited to 1000 $HV_{0.025}$. Furthermore, the present inventors have observed that the presence of hydrogen also causes embrittlement. It is likewise preferred in the method of the invention that the reactive atmosphere does not comprise a hydrogen containing species, e.g. $H_2$ or a hydrocarbon, since the microhardness of the diffusion zone is limited to 1000 $HV_{0.025}$.

The component of the invention can be regarded as having a composite layer on its surface, and the composite layer will provide the surface with a uniform hardness, which will be higher than the hardness of the diffusion zone and may be comparable to the microhardness of the carbo-oxide compound in the cross-section of the component. The surface hardness, e.g. in the unit $HV_{0.5}$, may be at least 1500 $HV_{0.5}$.

The diffusion zone and also the carbo-oxide compound may extend to a depth of 100 μm or more. However, already at a thickness of 10 μm the diffusion zone having oxygen and carbon in solid solution and a phase of carbo-oxide compounds of the composition $MeO_xC_{1-x}$ is advantageous, and in an embodiment of the invention the thickness of the diffusion zone having oxygen and carbon in solid solution and a phase of carbo-oxide compounds of the composition $MeO_xC_{1-x}$ is at least 10 μm, such as at least 50 μm. However, the tight integration of the carbo-oxide compound in the diffusion zone is especially advantageous for diffusion layers of a thickness of at least 50 μm. Thus, when a titanium alloy is provided with a layer of the diffusion zone having a thickness of at least 50 μm the titanium alloy is provided with a hard surface, which is resistant to wear and, in particular, the treated surface does not experience problems with spallation. In the context of the invention "spallation" relates to the layer provided in the hardening process, so that a component resistant to spallation has a robust layer, which is not prone to falling off due to mechanical wear. The thickness of the diffusion zone may also be higher than 50 μm, e.g. at least 100 μm or at least 200 μm.

The tight integration of the carbo-oxide compound in the diffusion zone to a depth of at least 50 μm further provides that the component of the invention has an improved corrosion resistance compared to components of the prior art. In an embodiment no sign of corrosion is evident on the component as determined in the steps of:

immersing the component in a test solution of 0.25 wt % HF adjusted to pH 1 with HCl for a test duration of 1 hour at a volume of 10 ml per g of the component;

measuring the absorbance of the test solution at a wavelength in the range of 400 nm to 500 nm, e.g. 450 nm after the test duration;

wherein an absorbance of $\leq 0.05\ cm^{-1}$ indicates no sign of corrosion. For example, a sample with a diffusion zone having oxygen and carbon in solid solution and a phase of carbo-oxide compounds showed no signs of corrosion after 16 days of treatment in the dilute hydrofluoric acid, whereas an untreated reference sample corroded immediately upon exposure to the acid as evident from measurement of the absorbance at 450 nm of the test solution. The diffusion zone of the tested sample had a thickness of about 200 μm. The corrosion resistance is also believed to be provided by the tight integration of the carbo-oxide compound and the diffusion zone with the core of the titanium alloy.

Without being bound by theory the present inventors believe that the tight integration of the carbo-oxide compound and the diffusion zone with the core of the titanium alloy provide the resistance to spallation and also the corrosion resistance. It is especially emphasised that a comparable resistance to spallation is not observed for a titanium component having a layer of a carbo-oxide on a titanium alloy even when the surface hardness of the carbo-oxide is comparable to that obtained in the present invention. When for example the carbo-oxide does not extend into a diffusion zone, i.e. when the microhardnesses of the carbo-oxide and the diffusion zone cannot be measured at the same depth from the surface of the component, spallation resistance is not observed.

The case hardened component of the invention has a diffusion zone with a microhardness of at least 800 $HV_{0.025}$ and a carbo-oxide compound with a microhardness of at least 1200 $HV_{0.025}$. In particular, the diffusion zone may have a microhardness of at least 800 $HV_{0.025}$ at a depth from the surface of the component in the range of 10 μm to 100 μm, e.g. 10 μm to 200 μm or 10 μm to 300 μm. Likewise, the microhardness of the carbo-oxide compound, as measured at the same depth as the microhardness of the diffusion zone is at least 1200 $HV_{0.025}$. It is preferred that the microhardness of the diffusion zone is at least 1000 HV, e.g. at least 1500 HV. For example, the diffusion zone may have a microhardness of at least 1000 $HV_{0.025}$ at a depth from the surface of the component in the range of 10 μm to 100 μm, or 10 μm to 200 μm, or 10 μm to 300 μm, or it may have a microhardness of at least 1500 $HV_{0.025}$ at a depth from the surface of the component in the range of 10 μm to 100 μm, or 10 μm to 200 μm, or 10 μm to 300 μm. Likewise, the microhardness of the carbo-oxide compound, as measured at the same depth as the microhardness of the diffusion zone may be at least 2000 $HV_{0.025}$. In a further specific embodiment microhardness of the carbo-oxide compound is at least 2500 $HV_{0.025}$ at a depth from the surface of the component in the range of 10 μm to 100 μm, or 10 μm to 200 μm, or 10 μm to 300 μm.

It is further preferred that the surface hardness is at least 1500 HV, e.g. at least 2000 HV, at least 2500 HV or at least 3000 HV. In specific embodiments the diffusion zone of the component has a thickness of at least 100 μm, e.g. at least 200 μm, at least 300 μm, at least 400 μm or at least 500 μm.

The diffusion zone is easily discernible when a cross-section of the treated titanium alloy is observed visually, e.g. using an optical microscope or an electron microscope, and the thickness of the diffusion layer can thus be measured by observation of the cross-section. The interface between the diffusion zone and the core of the titanium alloy is visible, e.g. by optical microscopy, in the cross-section of the titanium alloy, where the core of the titanium alloy is represented by crystals, e.g. α and/or β crystals, and the diffusion zone is represented by a uniform appearance. Thus, the thickness of the diffusion zone can be recorded from the surface of the titanium alloy to the interface between the diffusion zone and the core. A maximum thickness of the diffusion zone of up to about 2000 μm, e.g. up to about 1000 μm, can be obtained in the methods of the invention. It is also possible to differentiate the core from the diffusion zone by measuring the microhardness in the cross-section. For example, the visually observed limit between the core of the titanium alloy and the diffusion zone will typically correspond to the depth from the surface of the component where the microhardness is 50% higher than the core microhardness of the titanium alloy.

The method of producing a case hardened component of the invention employs a carbon providing gaseous species. A preferred carbon providing gaseous species is CO or CO and $CO_2$ at a ratio of CO to $CO_2$ of at least 5. However, it is also contemplated that CO and/or $CO_2$ may be replaced with other species. Unless otherwise noted the carbon providing gaseous species may always be CO or CO and $CO_2$ in any embodiment of the method of the invention.

In another aspect the invention relates to a method of oxidising a component of a Group IV metal, e.g. a titanium alloy, the method comprising the steps of:

providing a component of a Group IV metal, placing the component in an oxidising atmosphere comprising an oxidising gaseous species selected from the list consisting of $CO_2$, mixtures of CO and $CO_2$, $H_2O$ and mixtures of $H_2O$ and $H_2$, or mixtures thereof, wherein the oxidising gaseous species is selected to provide a partial pressure of $O_2$ of less than 0.1 bar, heating the component in an inert atmosphere or the oxidising atmosphere to an oxidising temperature $T_{Ox}$ of at least 600° C., maintaining the component in the oxidising atmosphere at $T_{Ox}$ for a reactive duration of at least 5 min to dissolve oxygen in the component, cooling the component from $T_{Ox}$ to ambient temperature.

The methods of the invention may be performed at a dissolution temperature $T_D$ above the alpha-to-beta transition ($T_\beta$) temperature of the Group IV metal, e.g. the titanium alloy or the zirconium alloy, or of titanium or zirconium. When a Group IV metal, e.g. a titanium alloy, is treated above $T_\beta$ the crystal structure of the Group IV metal, e.g. a titanium alloy, will change so that the diffusion zone is easily visible on top of the core of the Group IV metal. For titanium $T_\beta$ is about 890° C., but certain alloying elements may decrease or increase $T_\beta$, as is well-known to the skilled person. In general, carbon, oxygen and nitrogen, e.g. when interstitially dissolved, are considered to increase $T_\beta$, and it is preferred that carbon and oxygen, and optionally nitrogen, are dissolved at a temperature of at least 900° C., such as in the range of 900° C. to 1200° C., or at least 1000° C., e.g. in the range of 1000° C. to 1200° C. The elements of i.a. aluminium, gallium, and germanium are also considered to increase $T_\beta$, whereas the elements of i.a. molybdenum, vanadium, tantalum, niobium, manganese, iron, chromium, cobalt, nickel, copper and silicon are generally considered to lower T. When the Group IV metal is treated above $T_\beta$ the Group IV metal will be core hardened, and in a specific embodiment the methods of the invention thus comprise a core hardening of the Group IV metal. When core hardening is desired this may be implicit in the steps of maintaining the component in the reactive atmosphere at $T_D$ or maintaining the component in the oxidising atmosphere at $T_{Ox}$ when $T_D$ or $T_{Ox}$ are at or above $T_\beta$. A core hardening may also be included as a discrete step of treating the Group IV metal at a temperature at or above $T_\beta$; the core hardening may thus be performed in an inert atmosphere, the reactive atmosphere or the oxidising atmosphere.

In a specific embodiment the diffusion zone has a microhardness of at least 1000 $HV_{0.025}$, and the carbo-oxide compound has a microhardness of at least 1500 $HV_{0.025}$, and the titanium alloy may be provided with a surface hardness of at least 1500 $HV_{0.5}$. In other embodiments of the invention the hardness of the diffusion zone is at least 1000 HV, e.g. at least 1200 HV.

In general, the thicker the diffusion zone, the more pronounced the advantages of the invention. However, the effects of the diffusion zone will typically not be improved at a thickness of the diffusion zone above 2000 μm. In an embodiment of the invention the diffusion zone has a thickness in the range of 50 μm to 2000 μm. For practical reasons, e.g. with respect to the reactive duration it is preferred that the diffusion zone has a thickness in the range of 100 μm to 1000 μm. The thickness may be controlled via the parameters of the method, in particular the partial pressure of the carbon providing gaseous, and thereby the corresponding activity of carbon ($a_C$) and partial pressure of $O_2$ ($pO_2$) and optionally also $N_2$ ($pN_2$), the dissolution temperature $T_D$, and the reactive duration. At a dissolution temperature $T_D$ of 800° C. it is possible to dissolve carbon into a Group IV metal, e.g. a titanium alloy, together with oxygen and also nitrogen depending on the composition of the reactive atmosphere. In general, the thickness of the diffusion zone is proportional to the reactive duration, and the higher the dissolution temperature $T_D$ the faster the dissolution of carbon, oxygen and optionally nitrogen into the Group IV metal. For the method of the invention the relation between the depth of dissolution and the reactive duration is typically parabolic so that a doubling of the dissolution depth, and thereby also of the diffusion zone, requires a four times longer reactive duration. For example, when the dissolution temperature $T_D$ is about 800° C. the reactive duration may be about 1 hour to obtain a thickness of 10 μm, when the dissolution temperature $T_D$ is about 900° C., the reactive duration may be about 5 minutes to obtain a thickness of 10 μm, and when the dissolution temperature $T_D$ is about 1000° C., the reactive duration may be about 1 minute to obtain a thickness of 10 μm. Other combinations of the dissolution temperature $T_D$ and the reactive duration may be that when the dissolution temperature $T_D$ is in the range of 850° C. to 950° C. the reactive duration may be 10 hours or more, e.g. in the range of 10 hours to 20 hours. When the dissolution temperature $T_D$ is above 950° C., e.g. in the range of 950° C. to 1050° C. the reactive duration may be in the range of 2 hours to 20 hours, e.g. 4 hours. When the dissolution temperature $T_D$ is above 1050° C., e.g. about 1080° C., the reactive duration may be in the range of 30 minutes to 6 hours, e.g. 1 hour.

The methods of the present invention may be defined with respect to the partial pressure of the carbon providing gaseous species containing carbon and oxygen and optionally also nitrogen and with respect to the partial pressure of the oxidising gaseous species. The carbon providing gaseous species and also the oxidising gaseous species may be a mixture of CO and $CO_2$, and at the temperatures employed, i.e. $T_D$ and $T_{Ox}$, CO and $CO_2$ will take part in Reaction 1 and Reaction 2 identified below.

$$CO(g)+\tfrac{1}{2}O_2(g)=CO_2(g) \qquad \text{Reaction 1}$$

$$2CO(g)=CO_2(g)+C \qquad \text{Reaction 2}$$

In particular, the activity of carbon ($a_c$) and the partial pressure of $O_2$ ($pO_2$) are determined from Equation 1 and Equation 2, so that partial pressure of $O_2$ is:

$$pO_2=\left(\frac{pCO_2}{pCO}\right)^2\exp\left(\frac{2\Delta G_1}{RT}\right) \qquad \text{Equation 1}$$

and the activity of carbon is:

$$a_C=\left(\frac{pCO}{pCO_2}\right)^2\exp\left(\frac{-\Delta G_2}{RT}\right) \qquad \text{Equation 2}$$

where $\Delta G_1=-282.200+86.7\ T$ (J), and $\Delta G_2=-170.550+174.3\ T$ (J).

In general, the respective partial pressures are selected, within the limits defined above, so as to provide a carbon activity $a_c$ of at least $10^{-5}$ and a partial pressure $pO_2$ of up to 0.1 bar for the method of the first aspect of the invention. In the context of the invention the partial pressures calculated from Equation 1 and Equation 3 are thermodynamic partial pressures, and for the method of the second aspect of the invention $pO_2$ is preferably at or below the limit, e.g. slightly below, where oxide compounds form with the Group IV metal, e.g. a titanium alloy, as determined from an Ellingham diagram (as presented by Neil Birks, Gerald H. Meier & Frederick S. Pettit "Introduction to the high-temperature oxidation of metals", 2. Edition 2006, page 23, and D. R. Gaskell, "Introduction to the Thermodynamics of Materials" (Taylor and Francis, 1995) Third ed., pp. 347-395, showing Ellingham diagrams; Birks et al. and Gaskell are hereby incorporated by reference) and up to 0.1 bar. It is noted that the Ellingham diagram only concerns equilibrium conditions and it should be kept in mind that kinetics are also relevant for the methods of the invention. In particular, the value for $pO_2$ may also be outside the range suggested by the Ellingham diagram as long as the equilibrium is not reached.

Likewise, when a mixture of $H_2O$ and $H_2$ is used to oxidise the Group IV metal, e.g. a titanium alloy, $H_2O$ and $H_2$ will take part in Reaction 3:

$$H_2(g)+\tfrac{1}{2}O_2(g)=H_2O(g) \qquad \text{Reaction 3}$$

and the partial pressure of $O_2$ can be calculated from Equation 3:

$$pO_2=\left(\frac{pH_2O}{pH_2}\right)^2\exp\left(\frac{2\Delta G_3}{RT}\right) \qquad \text{Equation 3}$$

where $\Delta G_2=-247.000+55\ T$ (J).

The present inventors have now surprisingly found that stable Magnéli phases can be formed on the surface of a Group IV metal treated in either method aspect of the invention. In particular, the method of oxidising a component of a Group IV metal allows that a Magnéli phase is formed on the Group IV metal, e.g. titanium, in its pure form, i.e. without the presence of metal oxides, e.g. rutile or $TiO_2$, on or in the metal. Thus, the method of the invention allows formation of a Magnéli phase on titanium in the metallic form. It is noted that oxides are naturally present on titanium but that the unavoidable titanium oxides have not previously allowed formation of a Magnéli phase. Magnéli phases are suboxides of metals, for example, a Magnéli phase of titanium and oxygen may be generally denoted $Ti_nO_{2n-1}$, where n=4 to 10, and these may be detected using X-ray diffraction. Magnéli phases are generally highly resistant to corrosion, e.g. in aggressive acidic or basic solutions, such as HF, $BF_4$, $PF_6$, HCl, KOH and other highly oxidising agents, and they have high electrical conductivity.

When the partial pressure of $O_2$ is controlled in the method of oxidising a component of a Group IV metal of the invention it is possible to control the parameters to provide a Magnéli phase on the Group IV metal. In particular, the desired composition of the Magnéli phase may be controlled by controlling the amount of oxygen as explained above.

In specific embodiments the methods, of both aspects, comprise the step of monitoring the activity of carbon $a_c$ during the reactive duration and adjusting the carbon activity $a_c$ by introducing a carbon providing gaseous species, e.g. CO, to increase $a_c$ or a species, e.g. $CO_2$, to lower $a_c$, into the reactive atmosphere. Other embodiments comprise the step of monitoring the $pO_2$ during the reactive duration and adjusting $pO_2$ by introducing CO and/or $H_2$ into the reactive atmosphere to lower $pO_2$, or $CO_2$, $O_2$, and/or $H_2O$ into the reactive atmosphere to increase $pO_2$. In particular, $a_c$ and/or $pO_2$ may be adjusted to keep them within the desired ranges as defined above.

Group IV metals, e.g. titanium alloys, are generally extremely sensitive to gaseous species such as $O_2$, CO and $CO_2$, so that monitoring the $a_c$ and $pO_2$ and adjustment of the amount of the gaseous species allow improved control of the respective processes. In particular, $O_2$, CO, $CO_2$, and $H_2O$ may exist as contaminants in commonly employed industrial gasses in amounts capable of taking part in a dissolution process of a Group IV metal, e.g. a titanium alloy, so that effects of such contaminants can be avoided by the steps of monitoring and adjusting the reactive and/or oxidising atmospheres.

Methods of monitoring $a_c$ and $pO_2$ in a furnace, e.g. an industrial furnace, are known within the art, and appropriate devices for both exist.

The component to be treated may be heated, e.g. from an ambient temperature, to the dissolution temperature $T_D$ in the reactive atmosphere or the heating may take place in an inert atmosphere. Any inert atmosphere may be employed. In the context of the invention an inert atmosphere is an atmosphere not comprising molecules capable of reacting with the Group IV metal, e.g. the titanium alloy, at partial pressures where a reaction may take place. For example, an inert atmosphere may contain carbon containing species, nitrogen containing species and oxygen containing species at partial pressures up to $10^{-6}$ bar. At partial pressures up to $10^{-6}$ bar such species are considered present in amounts incapable of reacting with the Group IV metal. For example, an inert gas may be a noble gas, e.g. argon, neon or helium, with the unavoidable impurities present. It is preferred that other species, e.g. reactive species, in the reactive atmosphere and/or the oxidising atmosphere are limited to partial pressures up to about $10^{-5}$ bar.

After maintaining the component at the dissolution temperature $T_D$ or the oxidising temperature $T_{Ox}$ for the reactive duration the component is cooled to ambient temperature. The cooling method may be selected freely, e.g. the component may be cooled in the reactive gas or in an inert gas, or the cooling may take place in a liquid, e.g. water etc. When the heating and/or the cooling, e.g. to or from very high temperatures such as above 1000° C., takes place in an inert gas or under conditions without the presence of components capable of reacting with the Group IV metal, e.g. the titanium alloy, a better control of the process can be obtained. However, neither the rate of heating nor the rate of cooling are considered significant. In general, the diffusion zone formed on the Group IV metal, e.g. the titanium alloy, depends on the conditions under the reactive duration. Therefore, the rate of heating and/or the rate of cooling may be selected freely. For example, the rate of heating and/or the rate of cooling may be in the range of 10° C./min to 100° C./min.

The pressure of the carbon providing gaseous species is at least $10^{-5}$ bar. A minimum partial pressure of the carbon providing gaseous species of $10^{-5}$ bar is thermodynamically capable of dissolving carbon and oxygen into the Group IV metal, e.g. titanium, to eventually form the diffusion zone with the carbo-oxide compound. When a very low partial pressure of the carbon providing gaseous species is employed a high replacement rate of the carbon providing gaseous species should be employed in order to build the diffusion zone with the carbo-oxide compound. Furthermore, at very low partial pressure the reactive duration will be correspondingly longer. For example, at a partial pressure of the carbon providing gaseous species in the range of $10^{-5}$ bar to $10^{-2}$ bar the reactive duration will generally be at least 24 hours or more.

When a Group IV metal, e.g. a titanium alloy, is treated at a dissolution temperature $T_D$ of at least 600° C. and the carbon providing gaseous species at a partial pressure of at least $10^{-5}$ bar the elements of the carbon providing gaseous species will dissolve into the Group IV metal to form a diffusion zone. However, in order to also provide the carbo-oxide compound it is preferred that the partial pressure of the carbon providing gaseous species, e.g. CO or CO and $CO_2$ at a ratio of CO to $CO_2$ of at least 5, is at least $10^{-2}$ bar, such as at least 0.1 bar, or at least 0.2 bar, or at least 0.5 bar. For example, the pressure can be in the range of 0.01 bar to 1.0 bar, e.g. 0.1 bar to 0.5 bar.

The partial pressure of the carbon providing gaseous species, and any other gaseous species present in the reactive atmosphere may be adjusted freely using any technology. For example, the total pressure of an atmosphere may be reduced to bring the partial pressures of species present in the atmosphere within the desired ranges. Alternatively, a mixture of the gaseous species with an inert gas, such as a noble gas, e.g. argon, helium, neon, etc. may be employed as the reactive atmosphere. In a specific embodiment the reactive atmosphere consists of the carbon providing gaseous species. In another embodiment the reactive atmosphere consists of an inert gas, e.g. a noble gas, and the carbon providing gaseous species and the total pressure of the reactive atmosphere is in the range of 0.1 bar to 5 bar. When a mixture of gaseous species, e.g. the carbon providing gaseous species with a noble gas, is employed the content of the carbon providing gaseous species can be set to allow that the reactive atmosphere is provided as the mixture of gaseous species supplied at a total pressure close to ambient pressure or a slightly modified pressure, e.g. at a pressure in the range of 0.5 bar to 1.5 bar. Operation at a pressure in the range of 0.5 bar to 1.5 bar is advantageous since it will provide a more robust process compared to operation at a reduced total pressure, e.g. below 0.1 bar, since operation at reduced total pressure is susceptible to fluctuations in the partial pressure caused by a vacuum pump or leaks in the vacuum chamber.

When a carbon providing gaseous species other than CO and $CO_2$ is employed it may contain carbon and at least one of oxygen and nitrogen. Relevant nitrogen containing species are i.a. $N_2$ and $N_2O$. Any gaseous species comprising carbon and oxygen and optionally nitrogen may be used, and the reactive atmosphere may contain a single gaseous species or a mixture of gaseous species. Thus, the carbon providing gaseous species may be a single molecule, e.g. CO or $CO_2$, or the carbon providing gaseous species may be a mixture of different molecules. Other exemplary carbon providing gaseous species are dicarbon monoxide ($C_2O$), carbon suboxide ($C_3O_2$) and mixtures thereof. If the reactive atmosphere comprises hydrogen the present inventors, without being bound by theory, believe that the hydrogen will result in embrittlement of the treated alloy. When gaseous species are heated to $T_D$ most gaseous species will form $H_2$ so that the observed effect of hydrogen is relevant for any hydrogen containing species. For example, the reactive atmosphere should not contain hydrocarbons and compounds selected from the list consisting of $NH_3$, $N_2H_4$, $H_2$, and $H_2O$ Moreover, the present inventors have now surprisingly found that when carbon and oxygen and optionally nitrogen are dissolved in the titanium alloy, e.g. pure titanium or a titanium alloy, according to certain embodiments of the invention a phase of a carbo-oxide compound having the composition $TiO_xC_{1-x}$, wherein x is a number in the range of 0.01 to 0.99, will form in the diffusion zone. It is also contemplated that a compound having the composition $MeO_xN_yC_{1-x-y}$, e.g. $TiO_xN_yC_{1-x-y}$, wherein x and y are numbers in the range of 0.01 to 0.99 and wherein Me is a group IV metal, may form in the diffusion zone. The phase may appear as grains or as a more homogeneous superficial layer; in the context of the invention the terms "phase" and "grains" may be used interchangeably. In particular, the phase of the compound will typically extend from the surface of the component so that microhardness values can be recorded at the same depth for both the diffusion zone and the compound. If a phase of the carbo-oxide compound is formed as a continuous layer, which does not extend into the diffusion zone so that microhardnesses for the carbo-oxide compound and the diffusion zone cannot be measured at the same depth the advantages of the invention will not be obtained. Formation of a phase of carbo-oxide compounds with the titanium alloy according to the invention typically require that $T_D$ is at least 900° C., although it is preferred that $T_D$ is at least 1000° C.; the formation will typically also require that the partial pressure of the carbon providing gaseous species is at least 0.1 bar. However, carbo-oxides may also form at lower temperatures, e.g. at 850° C. or higher, and at lower pressures of the carbon providing gaseous species, e.g. 0.01 bar or even lower, although at temperatures and pressures outside the ranges defined for the method the reactive duration will in practice be prohibiting. Formation of a phase of carbo-oxide compounds with the titanium alloy will typically not depend on the reactive duration—if the partial pressure of the carbon providing gaseous species is sufficiently high combined with a sufficiently high $T_D$ the phase of carbo-oxide compounds with the titanium alloy will form. However, with an increased reactive duration the formation will be more pronounced. For example, when the partial pressure of the carbon providing gaseous species at least 0.5 bar and $T_D$ is at least 1000° C. a reactive duration of about 1 hour can lead to formation of a phase of carbo-oxide compounds with the titanium alloy.

In specific embodiments of the methods of the invention a phase of carbo-oxides of the Group IV metal, e.g. the titanium alloy, e.g. titanium carbo-oxides (as generally represented by the formula $TiC_xO_{1-x}$), as an example of the carbo-oxide compound, are formed in the diffusion zone at the surface of the titanium alloy. A representative example of titanium treated according to the method is depicted in FIG. 7, which shows a diffusion zone of a thickness of >100 μm, with a visible phase of carbo-oxides at the surface. It is thus preferred that $T_D$ is at least 1000° C., and the diffusion zone comprises a phase of a carbo-oxide compound having the composition $TiO_xC_{1-x}$, wherein x is a number in the range of 0.01 to 0.99. For example, x can be a number in the range of 0.1 to 0.9, e.g. a number in the range of 0.2 to 0.8, or a number in the range of 0.3 to 0.7. Typically, x will be at least 0.5. However, the phase of a carbo-oxide compound having the composition $TiO_xC_{1-x}$ may also be formed at a lower temperature, e.g. in the range of 900° C. to 1000° C., e.g. with a corresponding adjustment of the reactive duration. When the reactive atmosphere comprises a mixture of different molecules containing carbon and oxygen the phase of carbo-oxides can form. Formation of a phase of carbo-oxides will depend on the composition of the reactive atmosphere, so that when for example the carbon providing gaseous species is CO or a mixture of CO and $CO_2$ at a ratio of at least 5 CO to $CO_2$, carbo-oxides will typically form. At a ratio of CO to $CO_2$ in the range of at least 5 to 7 $T_D$ is preferably about 1000° C., e.g. in the range of 950° C. to 1050° C., for formation of carbo-oxides to occur. It is preferred that CO is used without addition of $CO_2$ when formation of carbo-oxides is desired. When formation of carbo-oxides is desired it is preferred that the reactive atmosphere does not comprise a nitrogen containing species. Regardless of the ratio between CO and $CO_2$ the activity of carbon $a_c$ should be at least $10^{-5}$ bar and the partial pressure of $O_2$ no more than 0.1 bar.

Exemplary conditions for formation of carbo-oxides are summarised in Table 1.

TABLE 1 formation of carbo-oxides

| Titanium grade | CO (v/v %) | $T_D$ (° C.) | Reactive duration (h) | Thickness of diffusion zone (μm) | Example |
|---|---|---|---|---|---|
| 2 | 17 | 925 | 68 | 300 | 1 |
| 2 | 17 | 1000 | 20 | 300 | 2 |
| 2 | 75 | 1000 | 20 | 400 | 3 |
| 5 | 60 | 1000 | 20 | 80 | 4 |
| 2 | 17 | 1050 | 20 | 500 | 5 |
| 2 | 60 | 1050 | 20 | 400 | 6 |
| 2 | 80 | 1080 | 1 | 200 | 7 |
| 2 | 80 | 1080 | 4 | 400 | 7 |
| 2 | 80 | 1080 | 16 | 500 | 7 |
| 2 | 80 | 1000 | 16 | 400 | 8 |
| 2 | 40 | 1000 | 4 | 200 | 9 |
| 2 | 80 | 1000 | 4 | 220 | 10 |
| 2 | 70[1] | 1000 | 4 | 120 | 11 |
| 2 | 80[2] | 1000 | 4 | 220 | 15 |
| 2 | 80[3] | 1000 | 4 | 270 | 16 |
| 2 | 80[4] | 1000 | 4 | 220 | 17 |

[1]further including 10%(v/v) $CO_2$
[2]further including 20%(v/v) $N_2$
[3]including a subsequent nitriding step
[4]including an initial nitriding step In Table 1 all conditions tested provided a diffusion zone of a thickness of at least 80 μm comprising a phase of carbo-oxides. The carbo-oxides in the surface advantageously increase the hardness of the surface of the titanium alloy and in specific embodiments the surface hardness, i.e. the macrohardness, of the treated titanium alloy is at least 1500 $HV_{0.5}$, such as at least 2000 $HV_{0.5}$, at least 2500 $HV_{0.5}$, at least 3000 $HV_{0.5}$ or more. When a phase of carbo-oxides is formed in the diffusion zone the hardness of the diffusion zone as analysed, e.g. by microhardness analysis, in the cross-section of the treated titanium alloy is in the range of 500 HV to 2000 HV, e.g. at least 800 HV or at least 1000 HV.

Without being bound by theory, the present inventors believe that integration of the phase of carbo-oxides in the diffusion zone and the tight integration of the diffusion zone with the core of the titanium alloy provide a hardened surface, which is extremely resistant to spallation, which combined with the hardness, e.g. of at least 1500 HV, provides a material of improved wear resistance.

Moreover, the diffusion zone provides the treated titanium alloy with high corrosion resistance.

The method of producing a case hardened component may further comprise a nitriding of the titanium alloy, e.g. in the steps of:

- placing the component in a nitriding atmosphere comprising a nitriding gaseous species at a partial pressure of at least $10^{-5}$ bar,
- maintaining the component in the nitriding atmosphere at a nitriding temperature $T_N$ of at least 800° C. for a nitriding duration of at least 5 min to diffuse nitrogen into the component.

When a nitriding step is included this process may be referred to as a "duplex process". Any nitriding procedure known in the art may be employed in the duplex process of the invention. In an embodiment of the invention the nitriding step is performed at a temperature below 800° C., and the nitriding may be based on gas, plasma or molten salt; such processes are known within the art. It is however preferred to perform the nitriding step in the duplex process as defined above. The nitriding step may be performed before or after the step of maintaining the component in the reactive atmosphere at $T_D$ for a reactive duration to provide the component with a diffusion zone comprising carbon and at least one of oxygen and nitrogen. When a duplex process is performed it is preferred that the carbon providing gaseous species does not contain nitrogen, e.g. that it comprises carbon and oxygen. The nitriding temperature $T_N$ is preferably in the range of 900° C. to 1100° C., e.g. about 1000° C. The nitriding duration is preferably in the range of 30 min to 10 hours, e.g. about 1 hour. The nitriding atmosphere is preferably $N_2$ without other active constituents, e.g. pure $N_2$ or $N_2$ mixed with a noble gas, e.g. argon. The nitriding atmosphere may also employ $NH_3$ as the nitriding gaseous species, and $NH_3$ may be used in place of or in combination with $N_2$ under the conditions defined above.

Performing the nitriding step after treatment in the reactive atmosphere will result in at least partial conversion of the diffusion zone into a diffusion zone also comprising nitrogen, e.g. a C—O-rich layer can be converted into a C—O—N containing layer. Dissolution of nitrogen into the diffusion zone will provide that the diffusion zone is significantly harder.

In the second method aspect the invention provides a method of oxidising a component of a titanium alloy. The present inventors have now surprisingly found that the activity of oxygen and carbon in the oxidising atmosphere may be controlled with respect to dissolution of oxygen into a Group IV metal, e.g. a titanium alloy, by controlling the ratio of oxygen atoms to carbon atoms, e.g. by using a mixture of CO and $CO_2$ or by controlling the ratio of oxygen atoms to hydrogen atoms when using a mixture of $H_2O$ and $H_2$ or by using mixtures thereof. Control of the ratios of the respective gaseous species can be used to control $pO_2$ as described above. It is preferred that the oxidising atmosphere does not comprise a reactive amount of a nitrogen containing species. It is further preferred that the oxidising atmosphere is not supplemented with $O_2$.

In the context of dissolution of oxygen and carbon into a Group IV metal, e.g. a titanium alloy, 100% CO can thus be considered to correspond to an infinitely high carbon activity and an oxidising atmosphere of only $CO_2$ can be considered to provide pure oxidation. It is therefore possible to tailor the contents O and C in solid solution in the Group IV metal, e.g. the titanium alloy, and moreover also to tailor the amounts of O and C present in carbo-oxides formed in the Group IV metal, e.g. as $TiO_xC_{1-x}$. Exemplary ratios of $CO_2$:CO are ratios in the range of 100:1 to 10:1. However, the ratio may also be lower, e.g. down to about 1:1 or even less. It is preferred that $T_{Ox}$ is at least 800° C., e.g. in the range of 900° C. to 1100° C. In addition, an oxidising atmosphere of a mixture of $CO/CO_2$ provides a "buffer capacity" as the mixture will react with any impurities, e.g. $O_2$ caused by leaks in the furnace, and maintain the desired conditions. An optimal ratio of $CO/CO_2$ to provide the buffer capacity is about 1:1. This is especially relevant under continuous flow of gasses in the furnace. It is preferred to introduce both C and O in the surface since this will provide a rapid dissolution and a high hardness is achieved. It is further preferred to use the mixture for pure oxidation, since a great degree of control of $pO_2$ is obtained. This is particularly relevant for Group IV metals, e.g. titanium or zirconium alloys, which are highly sensitive toward oxidation. Using $O_2$ as an oxidising species is difficult to control so that it may be necessary to employ very low (partial) pressures of $O_2$, e.g. in the range of $10^{-6}$ bar to $10^{-5}$ bar, in order to prevent formation of oxide compounds with the Group IV metal, e.g. the titanium or zirconium alloys. Thus, oxidation using $CO_2$, e.g. pure $CO_2$, $CO_2$ mixed with an inert gas, e.g. a noble gas, or a mixture of $CO_2$ with a small fraction of CO, e.g. at a ratio of $CO_2$:CO of at least 10:1, can allow dissolution of oxygen into solid solution in the Group IV metal without formation of oxides with the Group IV metal.

In an embodiment of the invention the oxidising atmosphere consists of the oxidising gaseous species. In another embodiment of the invention the oxidising atmosphere consists of a noble gas and the oxidising gaseous species and the total pressure of the oxidising atmosphere is in the range of 0.5 bar to 5 bar, e.g. 0.5 bar to 2 bar. Operation at a pressure in this range, e.g. the range of 0.5 bar to 1.5 bar, is advantageous since it will provide a more robust process compared to operation at a reduced total pressure, e.g. below 0.1 bar, since operation at reduced total pressure is susceptible to fluctuations in the partial pressure caused by a vacuum pump or leaks in the vacuum chamber.

The component is obtainable in the method of the invention, and in particular all advantages observed for components provided in the method of the invention are also relevant for the component of the invention, and the features and the corresponding advantages discussed above for the method aspect are also relevant for the component.

In general, all variations and features for any aspect and embodiment of the invention may be combined freely. The features described above for the method are thus equally relevant for the component of the invention.

BRIEF DESCRIPTION OF THE FIGURES

In the following the invention will be explained in greater detail with the aid of an example and with reference to the schematic drawings, in which.

DETAILED DESCRIPTION OF THE INVENTION

Figure 1:
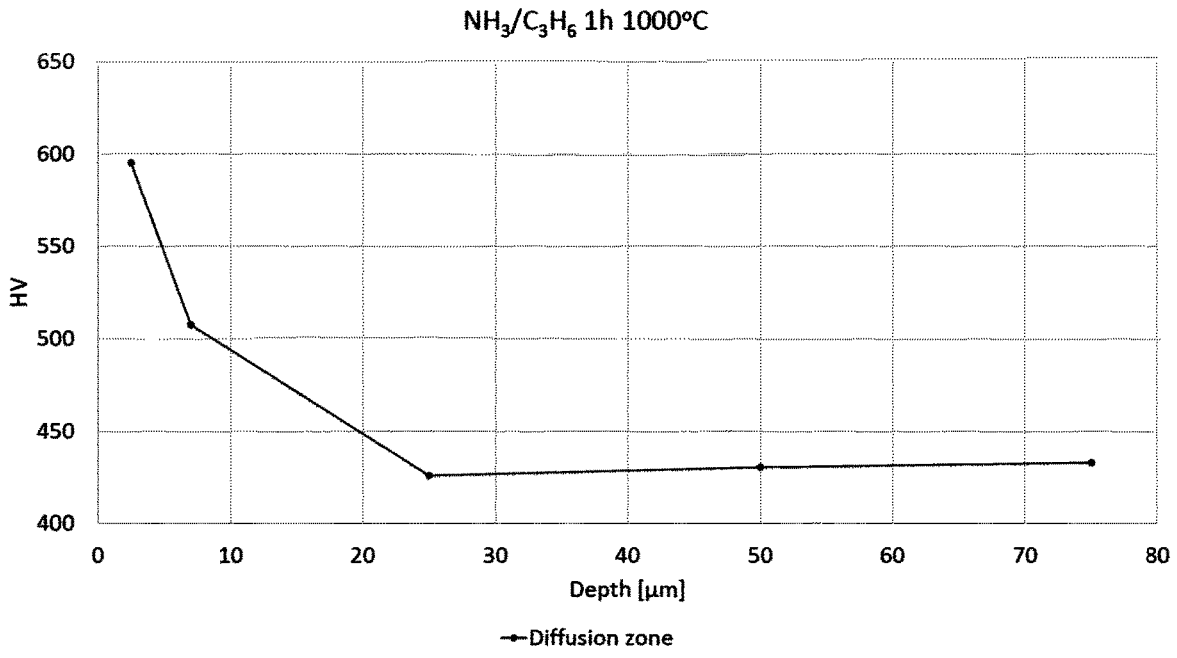
FIG. 1 shows a hardness profile of titanium grade 5 hardened with carbon and nitrogen in a prior art method.

The present invention in a first aspect relates to a method of producing a case hardened component of a Group IV metal. In a second aspect the invention relates to method of oxidising a component of a Group IV metal. In a third aspect the invention relates to case hardened component of a Group IV metal.

In the context of the invention "Group IV metal" is any metal selected from the titanium group of the periodic table of the elements or an alloy comprising at least 50% of metals from the titanium group. A "titanium alloy" is any alloy containing at least 50% (a/a) titanium, and likewise a "zirconium alloy" is any alloy containing at least 50% (a/a) zirconium. It is contemplated that for the method of the invention and for the component of the invention any alloy containing a sum of titanium and zirconium of at least 50% (a/a) is appropriate; this alloy is also considered a titanium alloy in the context of the invention, in particular if the alloy contains more titanium than zirconium. Likewise, the alloy may also comprise hafnium, which is a member of Group IV of the periodic table of the elements so that any alloy having a sum of titanium, zirconium, and hafnium of at least 50% (a/a) is appropriate for the invention.

When a percentage is stated for a metal or an alloy the percentage is by weight of the weight of material, e.g. denoted % (w/w), unless otherwise noted. When a percentage is stated for an atmosphere the percentage is by volume, e.g. denoted % (v/v), unless otherwise noted.

Any grade of titanium containing at least about 99% (w/w) titanium is, in the context of the invention, considered to be "pure titanium", e.g. Grade 1 titanium or Grade 2 titanium; thus, the pure titanium may contain up to about 1% (w/w) trace elements, e.g. oxygen, carbon, nitrogen or other metals, such as iron. In another embodiment the titanium alloy is the titanium alloy referred to as Ti-6Al-4V, which contains about 6% (w/w) aluminium, about 4% (w/w) vanadium, trace elements and titanium to balance. The alloy Ti-6Al-4V may also be referred to as Grade 5 titanium.

The alloys of relevance may contain any other appropriate element, and in the context of the invention an "alloying element" may refer to a metallic component or element in the alloy, or any constituent in the alloy. Titanium and zirconium alloys are well-known to the skilled person.

The component of the invention may be described by hardness measurements. In the context of the invention the hardness is generally measured according to the DIN EN ISO 6507 standard. If not otherwise mentioned the unit "HV" thus refers to this standard. The hardness may be measured at the surface of the component or in a cross-section of the component. The hardness measurement in the cross-section may also be referred to as "microhardness", and the hardness measurement at the surface may also be referred to as "macrohardness". The microhardness measurement is generally independent of the testing conditions, since the measurement is performed at microscale in the cross-section. Microhardness measurements are typically performed at a load of 25 g, i.e. $HV_{0.025}$, or 50 g, i.e. $HV_{0.05}$. In contrast, the macrohardness is performed from the surface with a much higher load, e.g. 0.50 kg, corresponding to $H_{v0.5}$, so that the measurement represents an overall value of the hardness of the respective material and whatever surface layers it contains. Unless noted otherwise the "surface hardness" is a macrohardness obtained with a load of 0.5 kg. Microhardness measurements at loads of 25 g or 50 g typically provide the same value, "HV", but measurement at 25 g is preferred since the measurement requires less space in the cross-section. The diffusion zone obtained according to the invention has a depth of least 50 μm, and in a specific embodiment the hardness of the diffusion zone in a cross-section of the component is at least 800 HV.

In a certain aspect the present invention relates to a component hardened in the method of the invention. In the context of the invention a "component" can be any workpiece, which has been treated in the method of the invention, and the component can be an individual object, or the component can be a distinct part or element of a whole.

The component of the present invention may inter alia be determined in terms of its thickness, and in an embodiment the component has a thickness of up to 50 mm, e.g. in the range of 0.4 mm to 50 mm. In the context of the invention the term "thickness" is generally understood as the smallest dimension of the three dimensions so that as long as an object has a dimension in the range of from 0.4 mm to 50 mm it can be said to have a thickness in the range of from 0.4 mm to 50 mm. The diffusion zone obtained in the method of the invention is especially advantageous for components with a thickness in the range of 0.4 mm to 50 mm, since the thickness diffusion zone may constitute up to about 1% or more of the thickness of the component.

The invention will now be described in the following non-limiting examples.

EXAMPLES

Comparative Example 1—Carbonitriding

A cylindrical (Ø10 mm) grade 5 titanium sample was treated in a Netzsch 449 Thermal analyzer (furnace). The furnace was evacuated and backfilled with nitrogen gas twice and a continuous gas flow consisting of 10 ml/min $N_2$+100 ml/min $NH_3$ and 10 ml/min $C_3H_6$ was applied. The sample was heated to 1000° C. at a rate of 20° C./min in the same gas mixture and upon reaching the temperature held there for 1 hour. Cooling was carried out at 50° C./min in the flowing process gas. This resulted in carbonitriding of the titanium surface yielding a brownish metallic luster. The total case depth, i.e. including the diffusion zone and the compounds formed with the titanium was 8 μm. The hardness profile obtained in the experiment is shown in FIG. 1. Thus, when the titanium sample was treated with a carbon providing gaseous species containing hydrogen but without oxygen a sufficient hardness could not be obtained, and moreover the thickness of the diffusion zone was low.

Comparative Example 2—Carbonitriding

Figure 2:
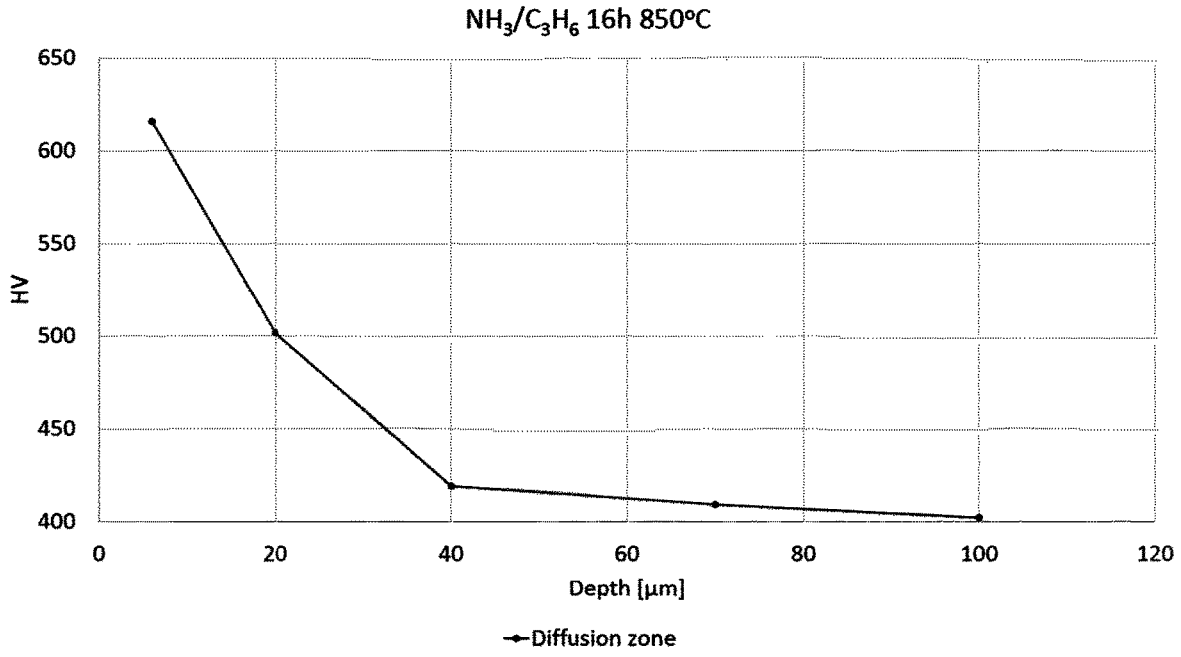
FIG. 2 shows a hardness profile of titanium grade 5 hardened with carbon and nitrogen in a prior art method.

A cylindrical (Ø10 mm) grade 5 titanium sample was treated in a Netzsch 449 Thermal analyzer (furnace). The furnace was evacuated and backfilled with nitrogen gas twice and a continuous gas flow consisting of 10 ml/min $N_2$+100 ml/min $NH_3$ and 10 ml/min $C_3H_6$ was applied. The sample was heated to 850° C. at a rate of 20° C./min in the same gas mixture and upon reaching the temperature held there for 16 hours. Cooling was carried out at 50° C./min in the flowing process gas. This resulted in carbonitriding of the titanium surface yielding a goldish metallic luster. The hardness profile obtained in the experiment is shown in FIG. 2. Despite formation of compounds, e.g. nitrocarbides, in the surface the obtained hardness was low.

Comparative Example 3—Hardening According to WO 97/14820

Figure 3A:
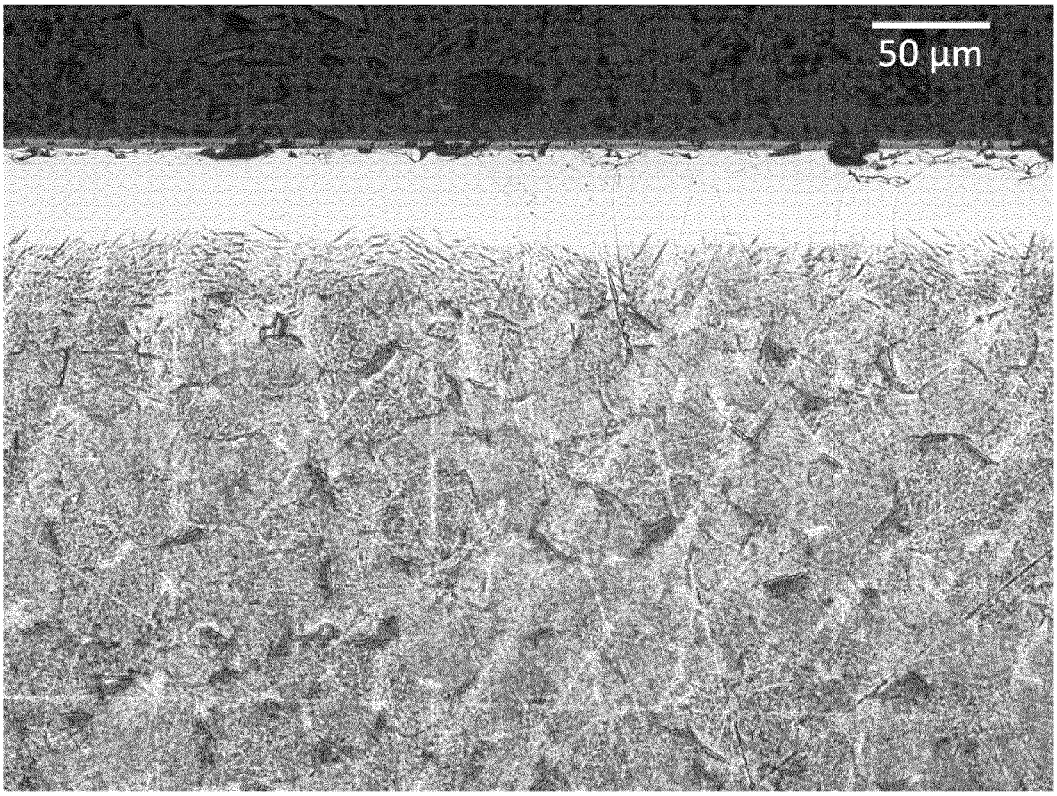
FIG. 3 shows cross-sections of titanium grades 2 and 5 hardened in a prior art method.
Figure 3B:
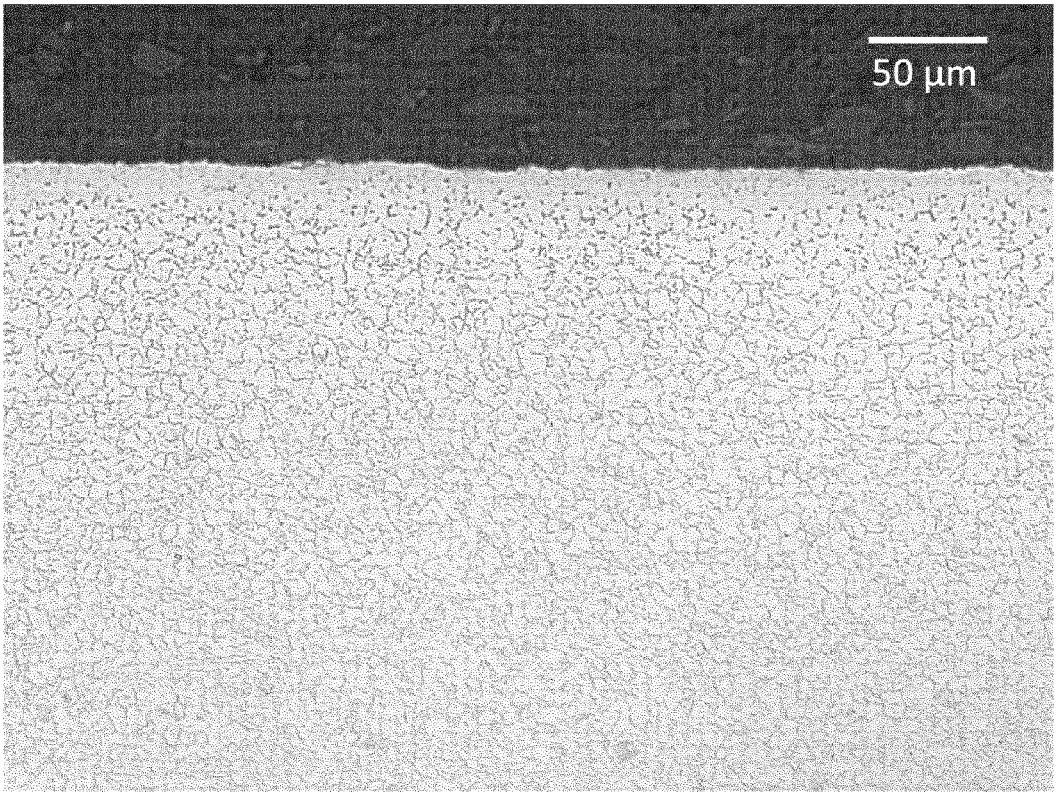

Experiments were set up to repeat the procedure of WO 97/14820. Specifically, specimens of grade 2 and grade 5 titanium were treated in a gas composition of 40% $H_2$+40% $N_2$+20% CO at a temperature of 899° C. The total pressure was ambient and the treatment time was 2 hours. Cross-sections of the treated material are shown in FIG. 3 and hardness profiles are shown in FIG. 4. In comparison with Comparative Examples 1 and 2, the treatment gas contained both carbon and oxygen, i.e. CO as a carbon providing species, and the partial pressure of the carbon providing species was within the range relevant to the present invention. However, the gas atmosphere also contained hydrogen, which is believed to cause the insufficient hardening.

Figure 4A:
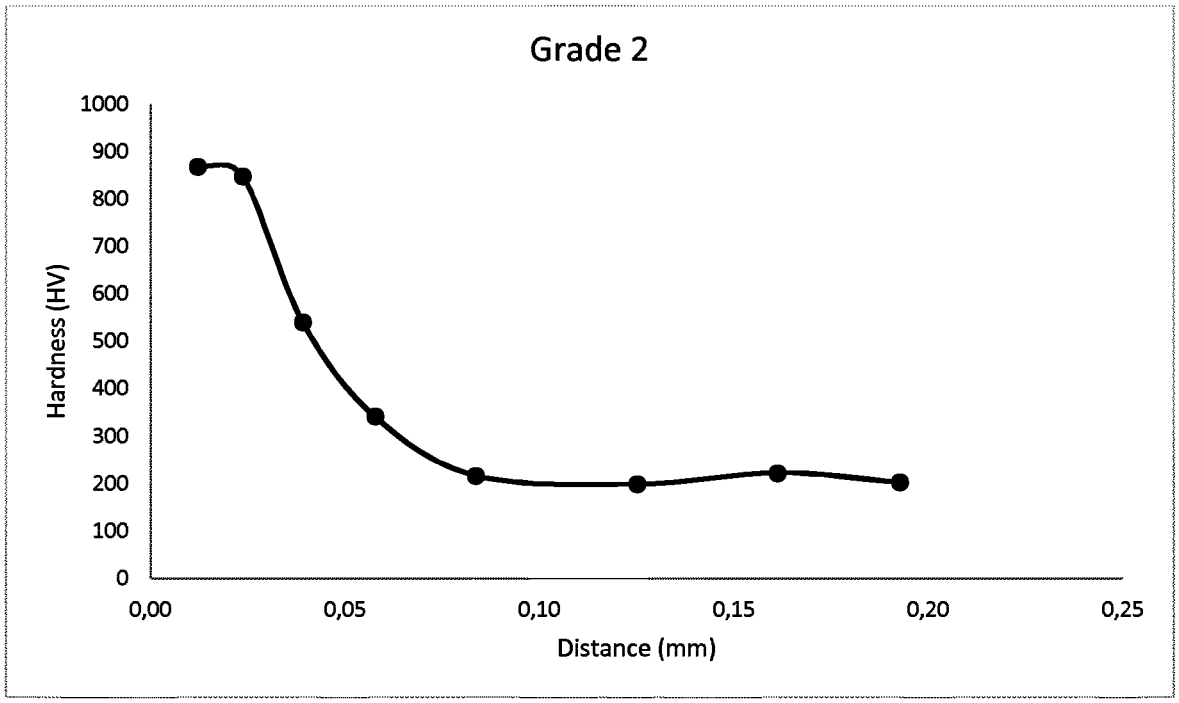
FIG. 4 shows hardness profiles of titanium grades 2 and 5 hardened in a prior art method.

Thus, treatment of grade 2 titanium provided (FIG. 3*a*) a diffusion zone and a top layer of relatively soft and brittle (ceramic) rutile ($TiO_2$). The surface zone was generally brittle and without being bound by theory the present inventors believe that the hydrogen in the treatment gas has resulted in the embrittlement. There was no formation of compounds in the diffusion zone, nor of a compound layer on the diffusion zone. The treatment did result in a hardening of the grade 2 titanium as seen in FIG. 4*a*, but the hardening was only superficial, e.g. at a depth of 50 μm the microhardness was only slightly higher than the core hardness of the alloy.

Figure 4B:
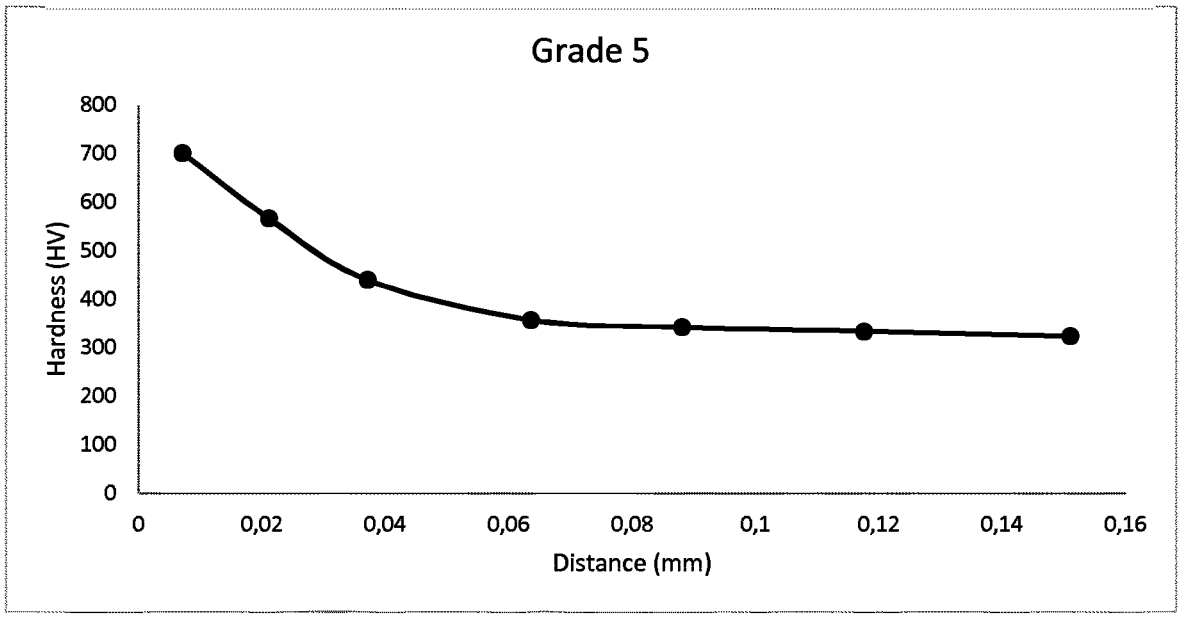

For grade 5 titanium the treatment resulted in a thin diffusion zone (FIG. 3*b*) of a relatively low hardness (FIG. 4*b*). In particular, there was no formation of compounds in the diffusion zone, nor of a compound layer on the diffusion zone and the same observations made for grade 2 titanium are relevant for grade 5 titanium.

Example 1—Carbo-Oxidation of Titanium Grade 2

A cylindrical (Ø10 mm) grade 2 titanium sample was treated in a Netzsch 449 Thermal analyzer (furnace). The furnace was evacuated and backfilled with argon gas twice and a continuous gas flow consisting of 50 ml/min Ar and 10 ml/min CO (17 vol. % CO) was applied. The sample was heated to 925° C. at a rate of 20° C./min in the same gas mixture and upon reaching the temperature held there for 68 hours. Cooling was carried out at 50° C./min in the flowing process gas. This resulted in carbo-oxidation of the titanium. A mixed interstitial compound $TiO_xC_{1-x}$ has formed in the surface on top of a zone of mixed interstitial solid solution based on carbon and oxygen ('diffusion zone').

Figure 5A:
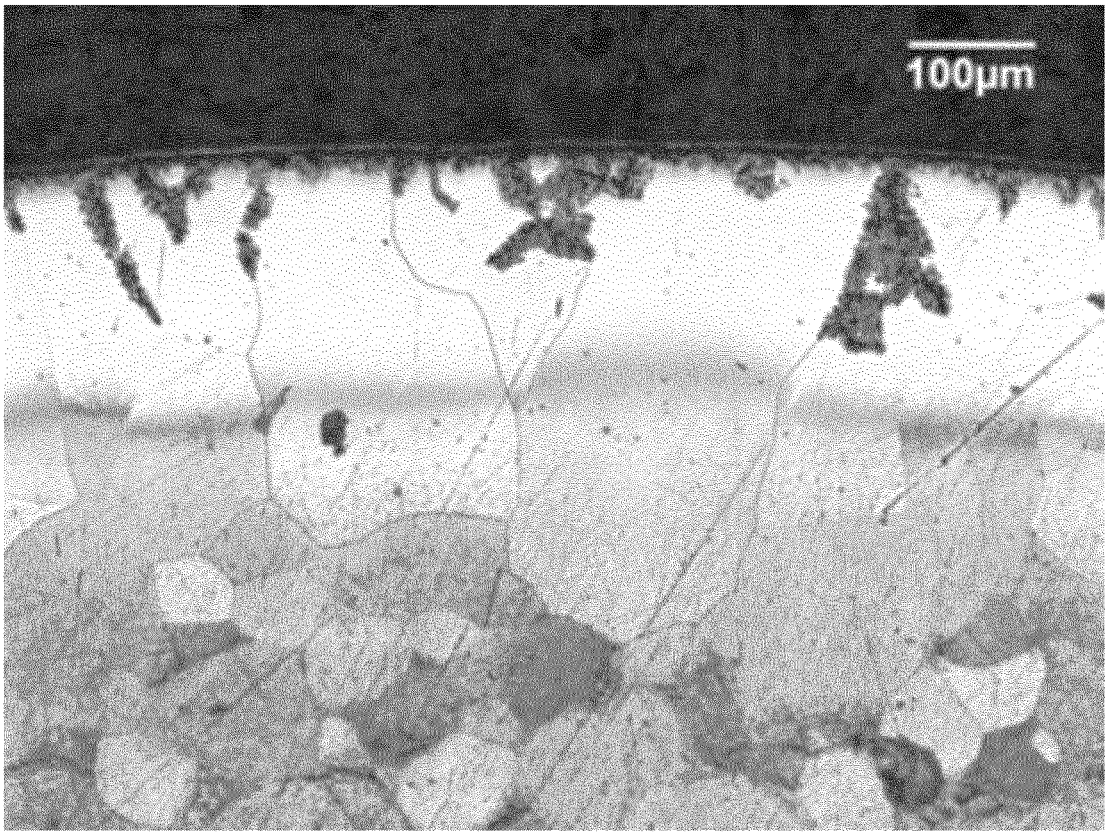
FIG. 5 shows a cross-section of titanium grade 2 hardened with carbon and oxygen in the method of the invention.
Figure 5B:
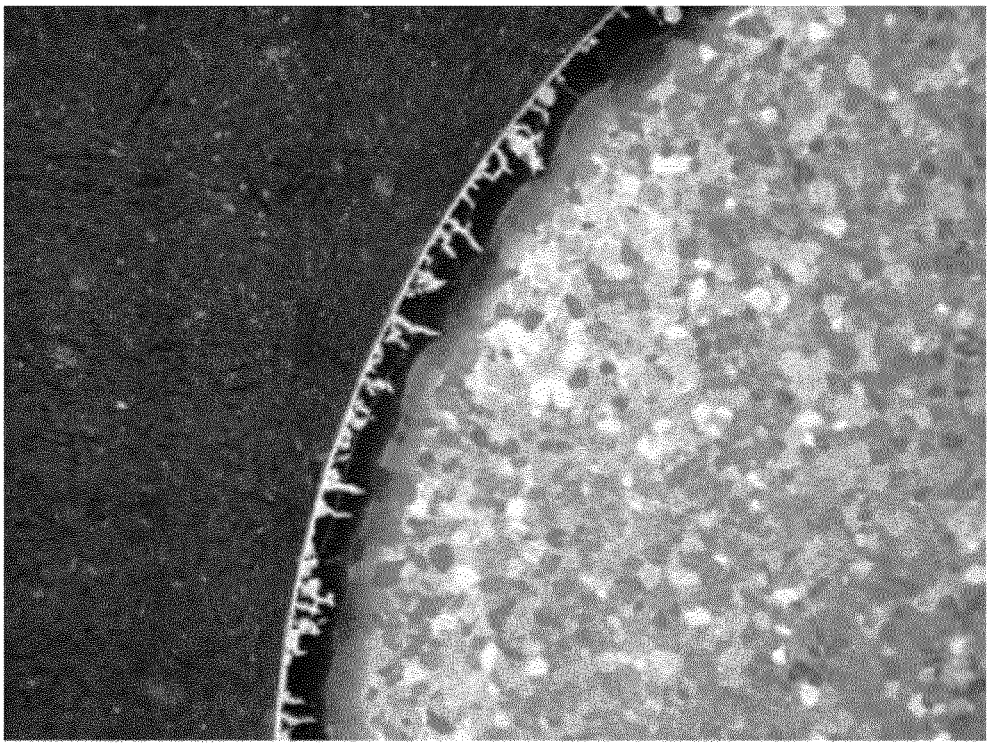

FIG. 5 shows, in FIG. 5*a* and FIG. 5*b*, respectively, reflected light optical microscopy and stereomicroscopy of the cross-section of the treated component. The hardened case consists of a surface zone of mixed interstitial compound $TiO_xC_{1-x}$ and a mixed interstitial solid solution (diffusion zone) containing both C and O.

Figure 6:
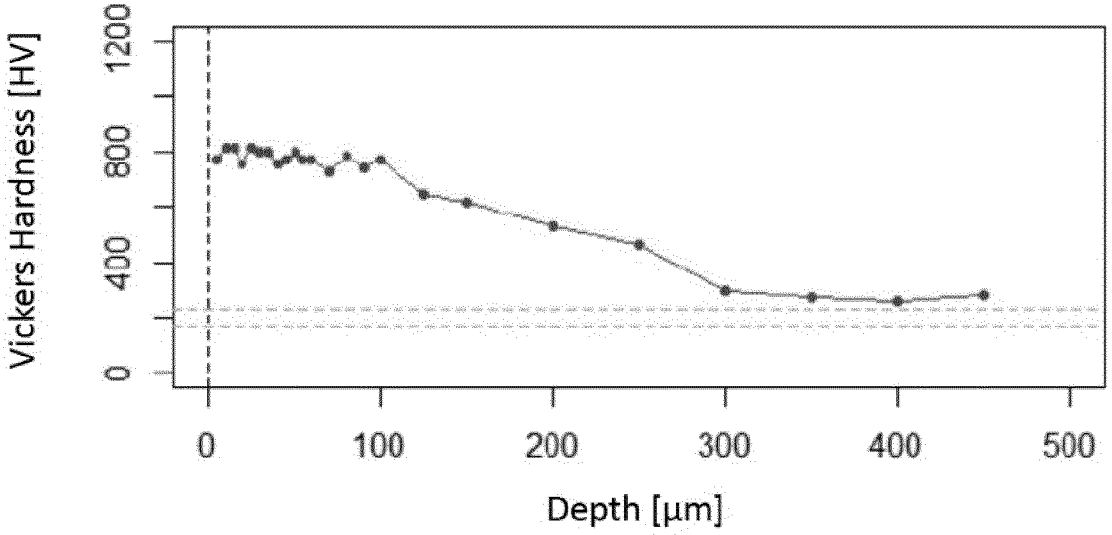
FIG. 6 shows a hardness depth profile of titanium grade 2 hardened with carbon and oxygen in the method of the invention.

The hardness depth profile of the mixed interstitial solid solution/diffusion zone is given in FIG. 6. The maximum hardness in the diffusion zone is 800 HV. The mixed interstitial compound $TiO_xC_{1-x}$, has an average hardness of 1530 HV. The hardened case depth is 300 μm. The horizontal dotted lines illustrate the core hardness of the titanium metal.

Example 2—Carbo-Oxidation of Titanium Grade 2

Figure 7:
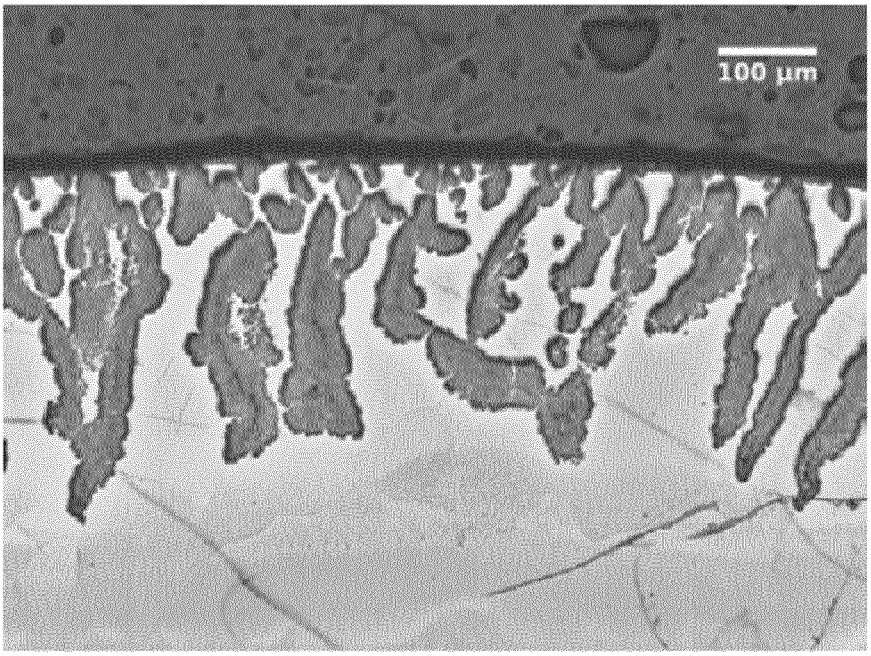
FIG. 7 shows a cross-section of titanium grade 2 hardened with carbon and oxygen in the method of the invention.

A cylindrical (Ø10 mm) grade 2 titanium sample was treated in a Netzsch 449 Thermal analyzer (furnace). The furnace was evacuated and backfilled with argon gas twice and a continuous gas flow consisting of 50 ml/min Ar and 10 ml/min CO (17% CO) was applied. The sample was heated to 1000° C. at a rate of 20° C./min in the same gas mixture and upon reaching the temperature held there for 20 hours. Cooling was carried out at 50° C./min in the flowing process gas. This resulted in carbo-oxidation of the titanium as seen in FIG. 7, which shows reflected light optical microscopy of cross-sections. A mixed interstitial compound $TiO_xC_{1-x}$ and mixed interstitial solid solution based on carbon and oxygen ('diffusion zone') have formed. The maximum hardness in the diffusion zone is 1148 HV0.025. The mixed interstitial compound $TiO_xC_{1-x}$, has an average hardness of 1819 HV0.025. The hardened case depth is approximately 300 μm.

Example 3—Carbo-Oxidation Titanium Grade 2

Figure 8:
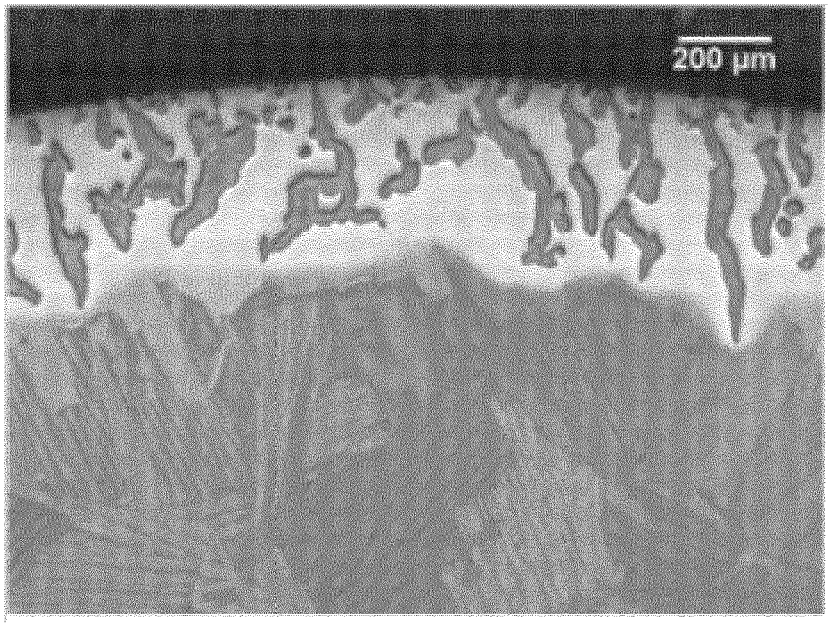
FIG. 8 shows a cross-section of titanium grade 2 hardened with carbon and oxygen in the method of the invention.

A cylindrical (Ø10 mm) grade 2 titanium sample was treated in a Netzsch 449 Thermal analyzer (furnace). The furnace was evacuated and backfilled with argon gas twice and a continuous gas flow consisting of 20 ml/min Ar and 30 ml/min CO (60 vol. % CO) was applied. The sample was heated to 1000° C. at a rate of 20° C./min in the same gas mixture and upon reaching the temperature held there for 20 hours. Cooling was carried out at 50° C./min in the flowing process gas. This resulted in carbo-oxidation of the titanium as seen in FIG. 8, which shows reflected light optical microscopy of cross-sections. A mixed interstitial compound $TiO_xC_{1-x}$ and a mixed interstitial solid solution based on carbon and oxygen ('diffusion zone') have formed. The case depth is approximately 400 μm. The core has transformed into a Widmanstätten structure, which demonstrates that a simultaneous core hardening and surface hardening took place.

Example 4—Carbo-Oxidation Titanium Grade 5

Figure 9:
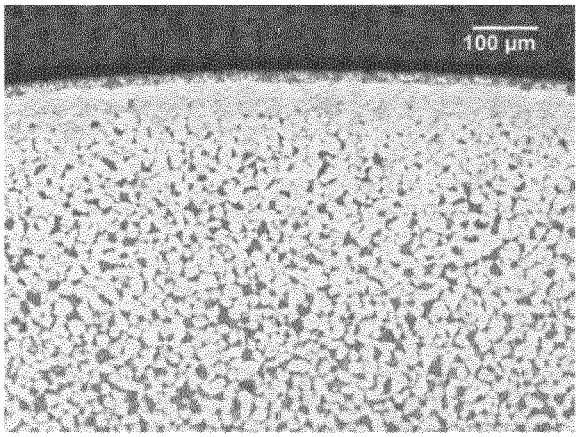
FIG. 9 shows a cross-section of titanium grade 5 hardened with carbon and oxygen in the method of the invention.
Figure 9:
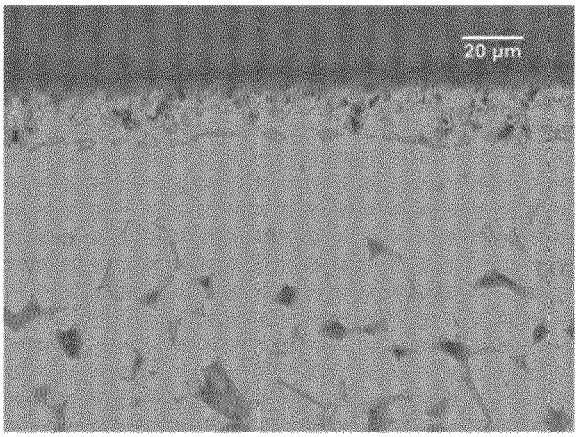

A cylindrical (Ø10 mm) grade 5 titanium sample was treated in a Netzsch 449 Thermal analyzer (furnace). The furnace was evacuated and backfilled with argon gas twice and a continuous gas flow consisting of 20 ml/min Ar and 30 ml/min CO (60% CO) was applied. The sample was heated to 1000° C. at a rate of 20° C./min in the same gas mixture and upon reaching the temperature held there for 20 hours. Cooling was carried out at 50° C./min in the flowing process gas. This resulted in carbo-oxidation of the titanium as seen in FIG. 9, which shows reflected light optical microscopy of cross-sections. A mixed interstitial compound $TiO_xC_{1-x}$ and a mixed interstitial solid solution based on carbon and oxygen ('diffusion zone') have formed. The hardness of the $TiO_xC_{1-x}$ is 1416 HV0.025. The case depth is approximately 80 μm. The core has transformed into an α/β structure, i.e. simultaneous core and surface hardening took place.

Example 5—Carbo-Oxidation

Figure 10:
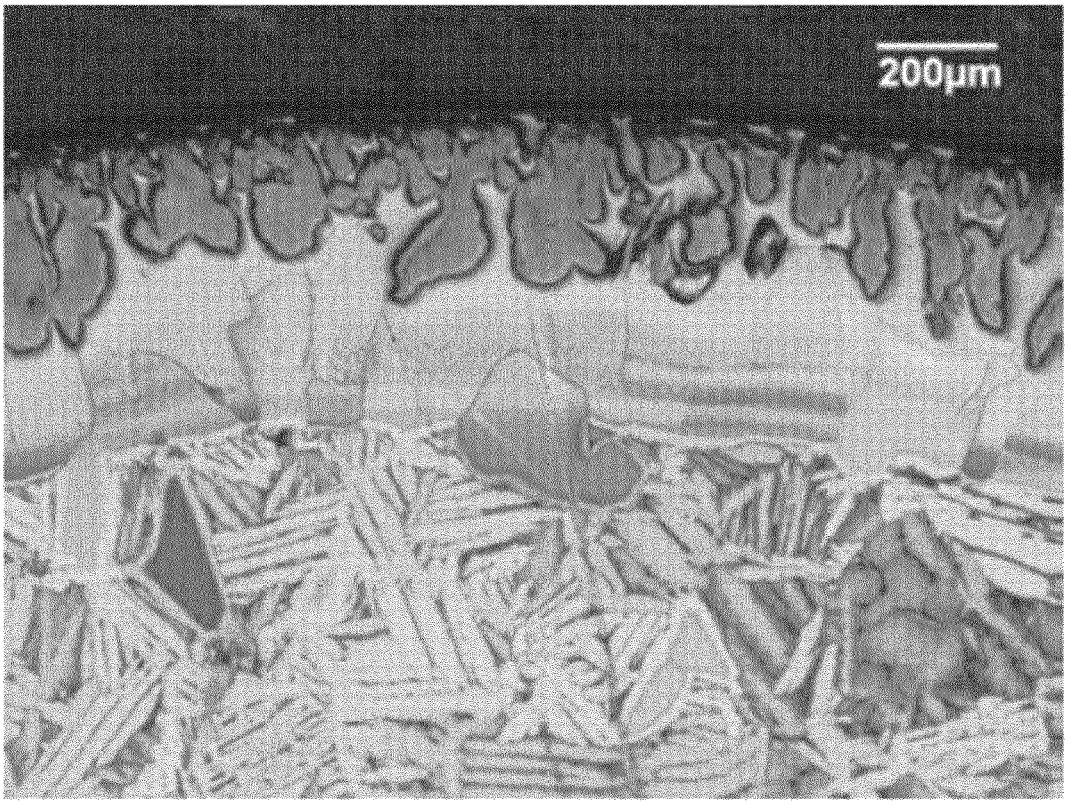
FIG. 10 shows a cross-section of titanium grade 2 hardened with carbon and oxygen in the method of the invention.

A cylindrical (Ø10 mm) grade 2 titanium sample was treated in a Netzsch 449 Thermal analyzer (furnace). The furnace was evacuated and backfilled with argon gas twice and a continuous gas flow consisting of 50 ml/min Ar and 10 ml/min CO (17% CO) was applied. The sample was heated to 1050° C. at a rate of 20° C./min in the same gas mixture and upon reaching the temperature held there for 20 hours. Cooling was carried out at 50° C./min in the flowing process gas. This resulted in carbo-oxidation of the titanium as seen in FIG. 10, which shows reflected light optical microscopy of cross-sections. A mixed interstitial compound $TiO_xC_{1-x}$ and a mixed interstitial solid solution based on carbon and oxygen ('diffusion zone') have formed. The case depth is approximately 500 μm. The core has transformed into a Wittmanstätten structure, i.e. simultaneous core and surface hardening. The hardness of the $TiO_xC_{1-x}$ is 1859 HV0.025 and the C+O rich diffusion zone up to 1145 HV0.025.

Example 6—Carbo-Oxidation Titanium Grade 2

Figure 11A:
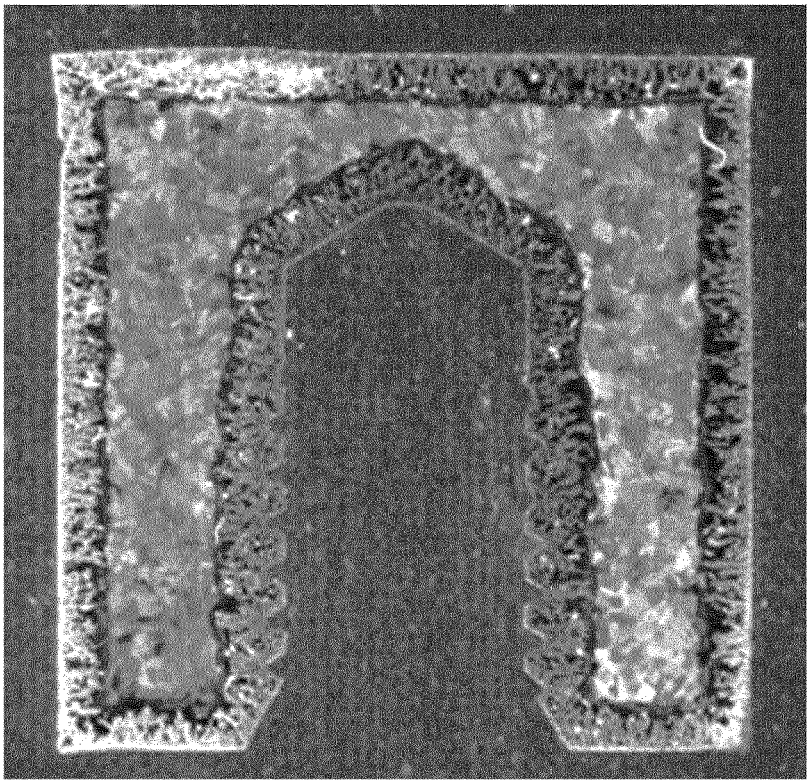
FIG. 11 shows cross-sections of a component of titanium grade 2 hardened with carbon and oxygen in the method of the invention.
Figure 11B:
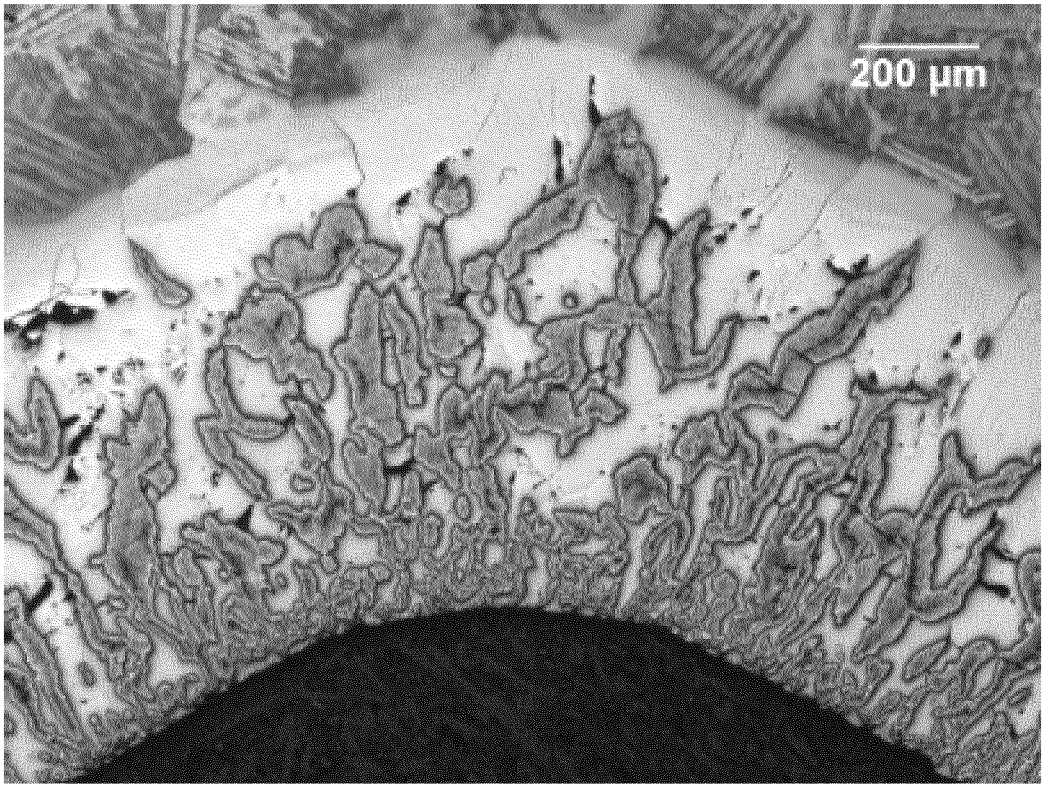

A cylindrical (Ø10 mm) grade 2 titanium sample was treated in a Netzsch 449 Thermal analyzer (furnace). The furnace was evacuated and backfilled with argon gas twice and a continuous gas flow consisting of 20 ml/min Ar and 30 ml/min CO (60% CO) was applied. The sample was heated to 1050° C. at a rate of 20° C./min in the same gas mixture and upon reaching the temperature held there for 20 hours. Cooling was carried out at 50° C./min in the flowing process gas. This resulted in carbo-oxidation of the titanium as seen in FIG. 11*a*, which shows a stereomicroscopy picture (8 times magnification) of a cross sectioned Ø10 mm cylindrical specimen with an ISO metric M4 thread and FIG. 11*b*, which shows reflected light optical micrographs of the cross-section of the sample. A mixed interstitial compound $TiO_xC_{1-x}$ and a mixed interstitial solid solution based on carbon and oxygen ('diffusion zone') have formed.

Figure 12A:
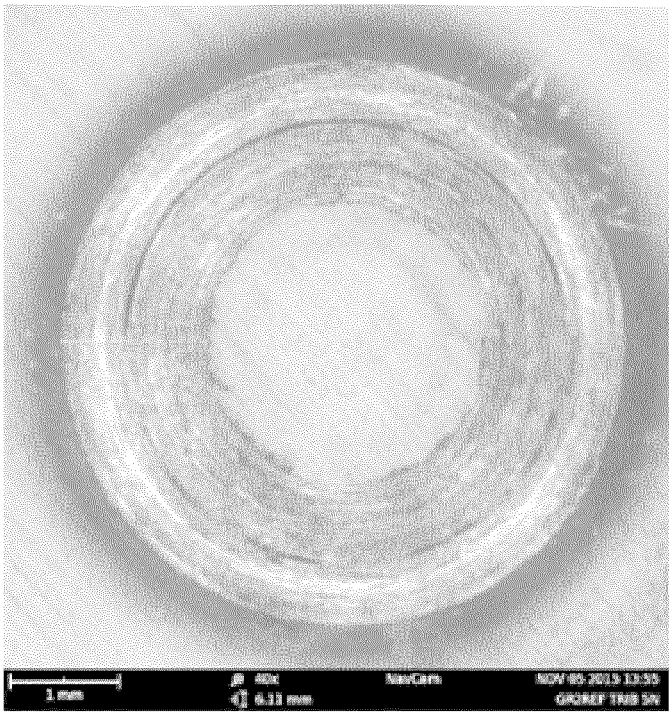
FIG. 12 illustrates tribological tests of titanium grade 2 hardened with carbon and oxygen in the method of the invention.
Figure 12B:
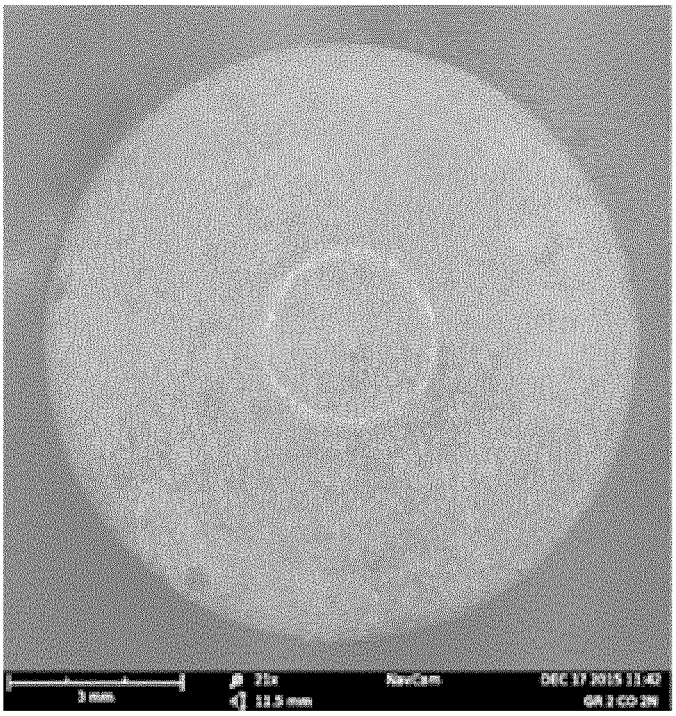
Figure 13A:
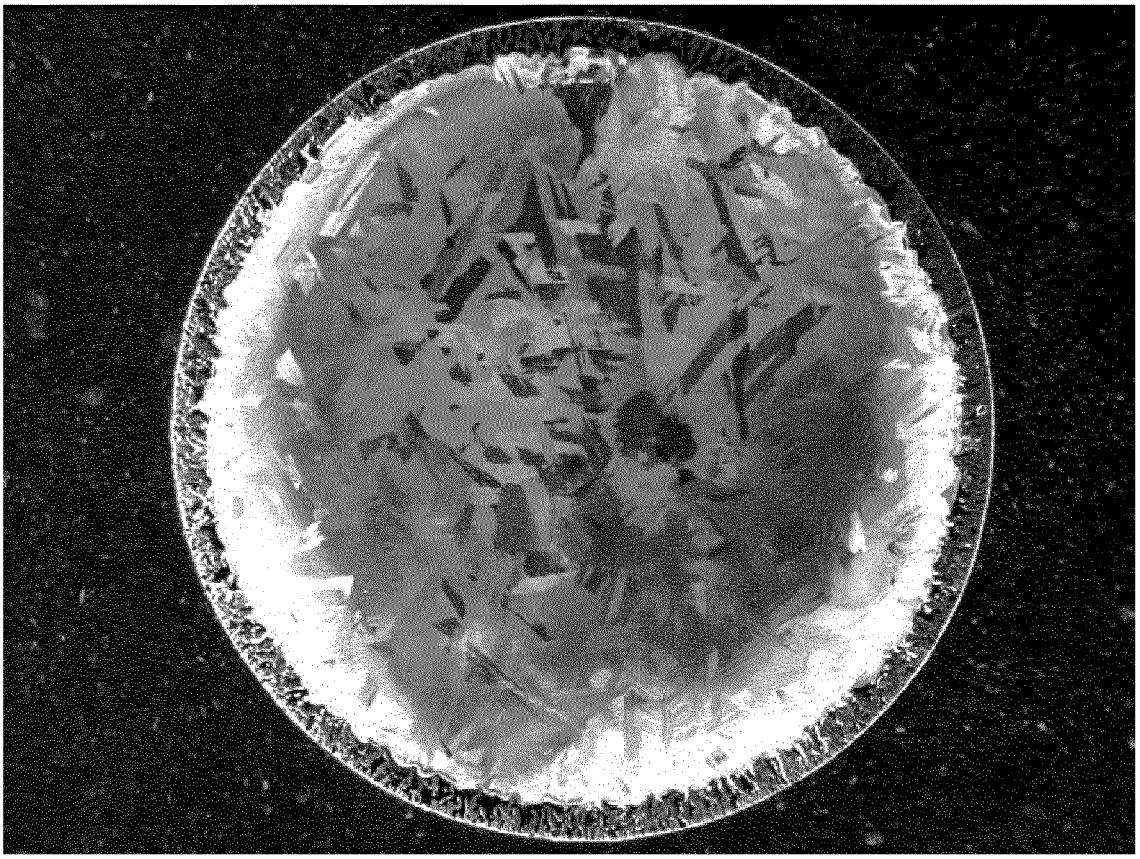
FIG. 13 illustrates corrosion tests of titanium grade 2 hardened with carbon and oxygen in the method of the invention.
Figure 13B:
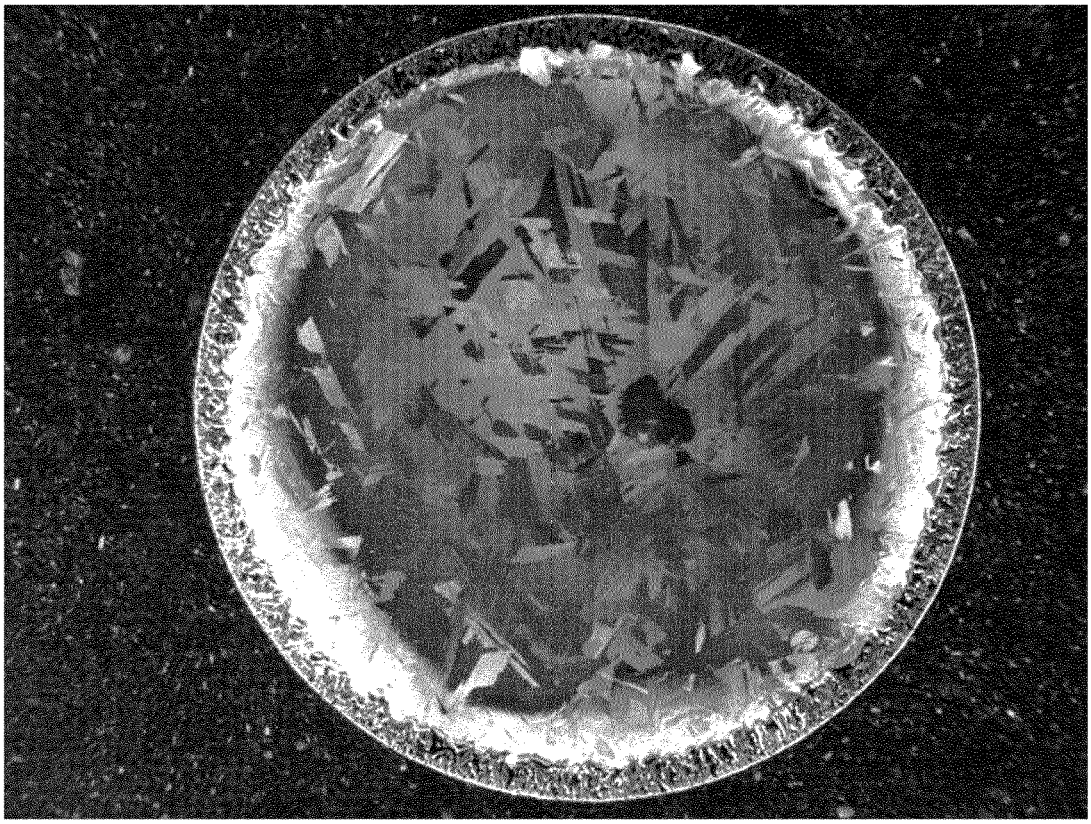
Figure 13C:
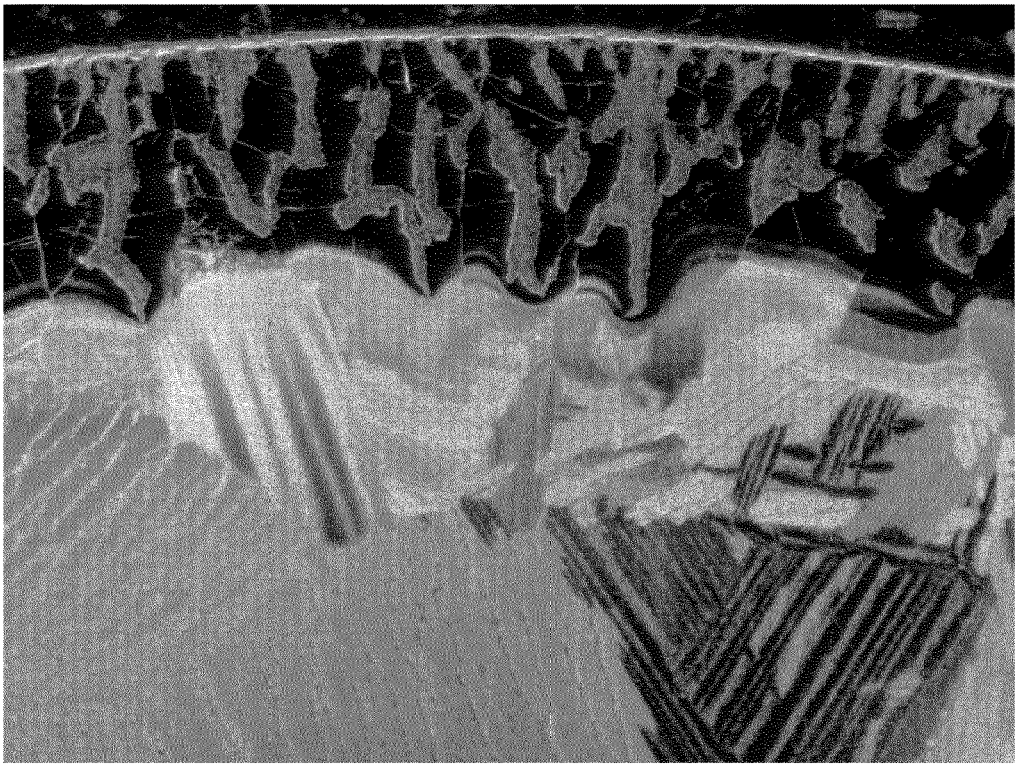
Figure 13D:
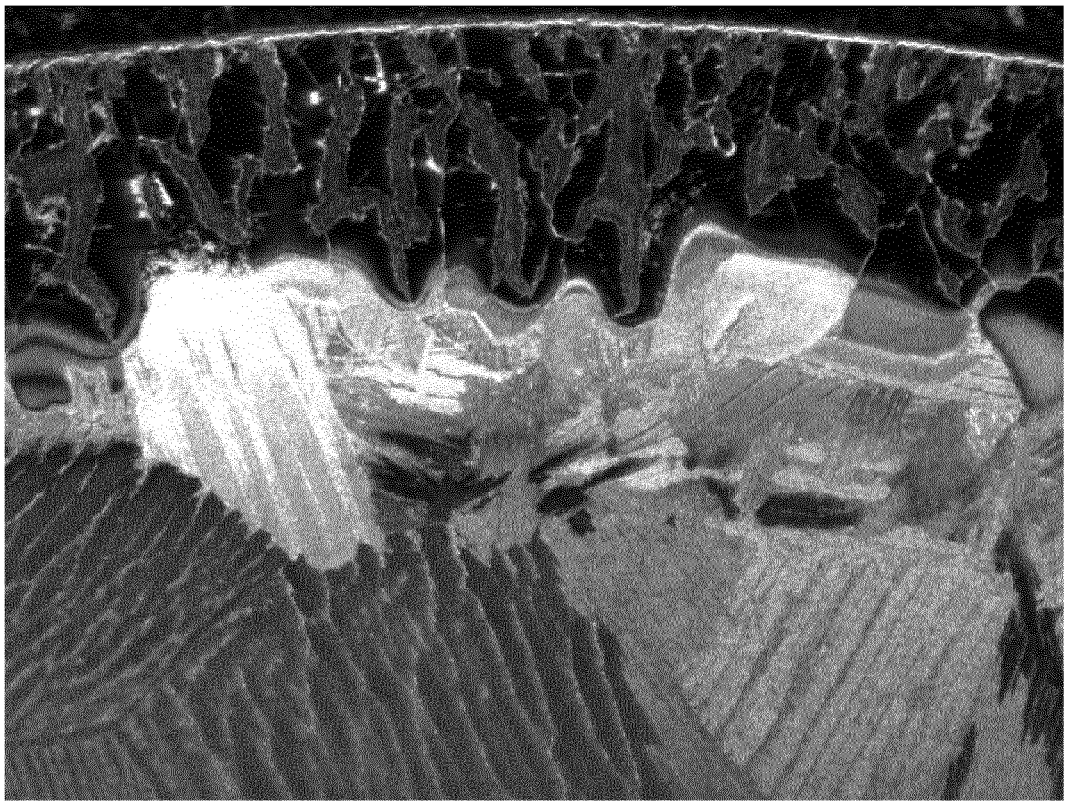

Wear and corrosion properties of untreated and treated grade 2 titanium were investigated by ball on disc tribology testing in Ringers solution. Results show less wear for the treated sample with a wear track width of 320 μm whereas untreated grade 2 titanium shows a wear track width of 1330 μm. There were no indications of corrosion for any of the samples tested. The results are depicted in FIG. 12, which shows SEM images of wear tracks after tribocorrosion ball on disc testing where FIG. 12*a* shows the results for the untreated sample and FIG. 12*b* shows the results for the sample treated as described above. The wear counterpart was a 6 mm diameter $Al_2O_3$ ball loaded with a normal force of 5N on the rotating sample disc for total 50 meter with a speed of 0.5 cm/s. Test solution was Ringers solution containing 0.12 g/l $CaCl_2$, 0.105 g/l KCl, 0.05 g/l $NaHCO_3$ and 2.25 g/l NaCl.

Another similar sample was immersed in a 200 ml solution 1 to 10 diluted Keller's reagent at 23° C. for 72 hours and inspected with stereomicroscopy and light optical microscopy for signs of corrosion. Even at high magnification there were no signs of corrosion seen as seen in FIG. 13, where FIGS. 13*a* and *c* show the sample before exposure to the Keller's reagent, and FIGS. 13*b* and *d* show the sample after exposure to Keller's reagent; the samples are shown at 8× magnification in panels a and c, and panels b and d show the samples at 80× magnification, respectively.

Example 7—Carbo-Oxidation Titanium Grade 2

Figure 14A:
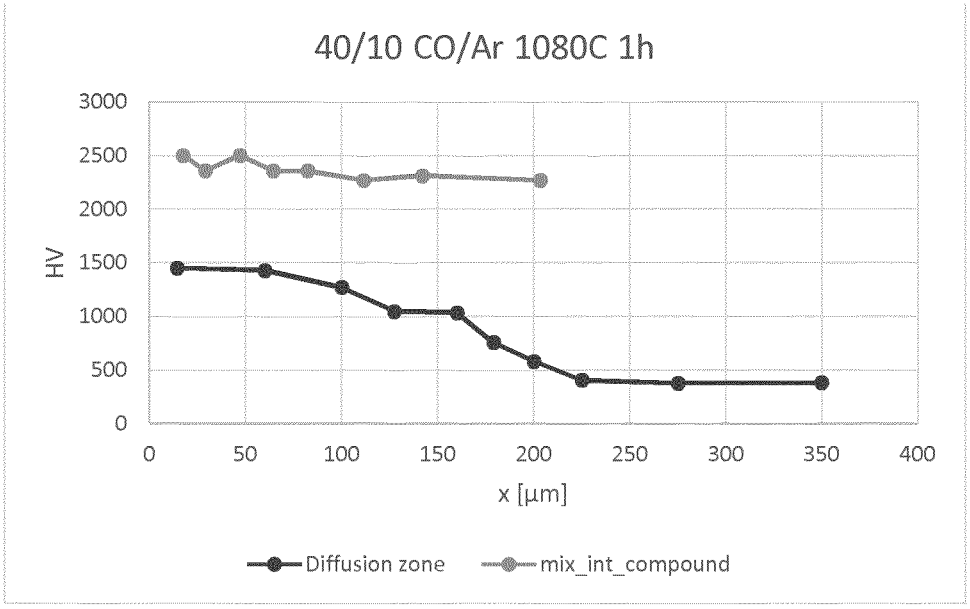
FIG. 14 shows hardness profiles of titanium grade 2 hardened with carbon and oxygen in the method of the invention.
Figure 14B:
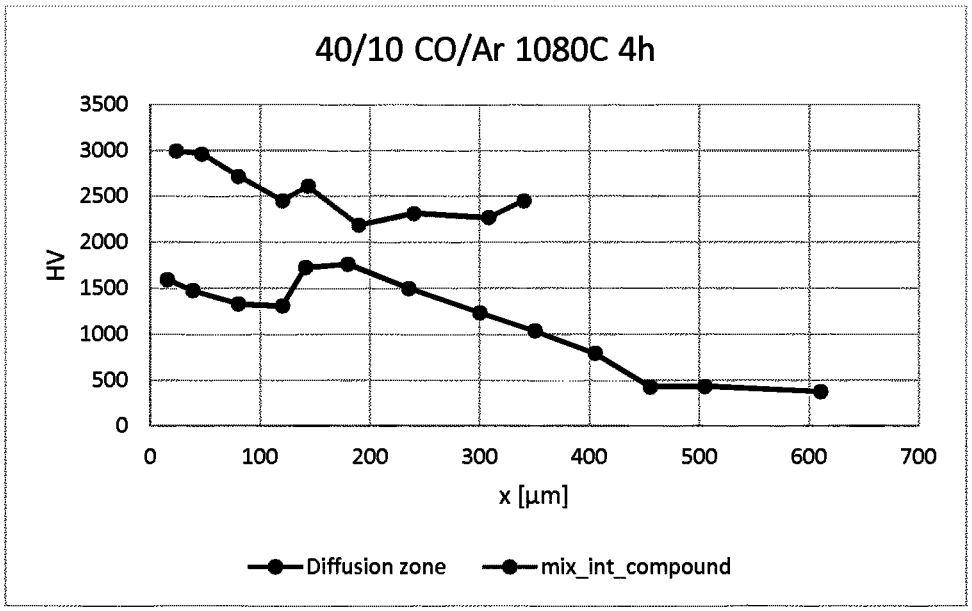
Figure 14C:
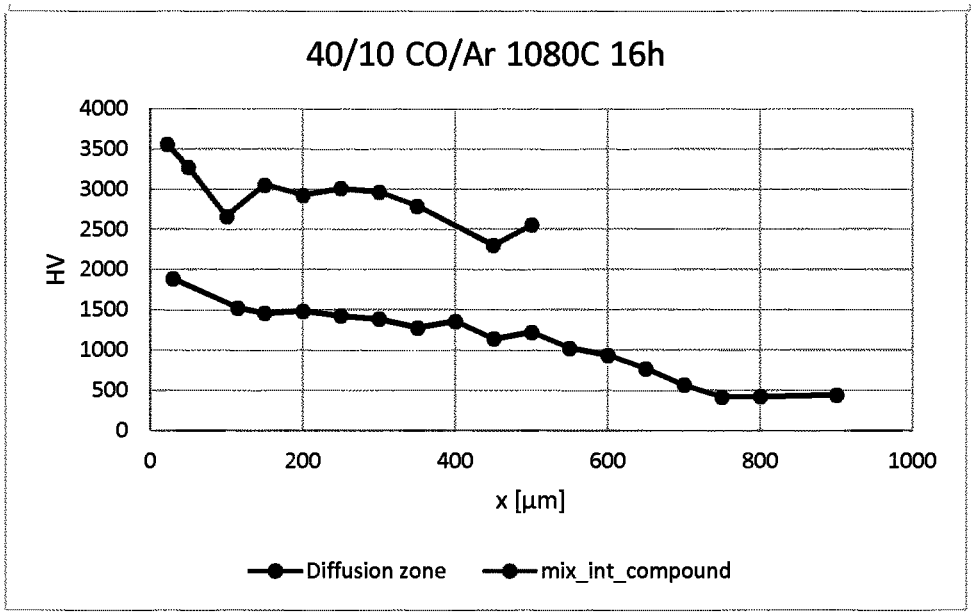

Cylindrical (Ø10 mm) grade 2 titanium sample were treated in a Netzsch 449 Thermal analyzer (furnace). For all experiment, the furnace was evacuated and backfilled with argon gas twice and a continuous gas flow consisting of 10 ml/min Ar and 40 ml/min CO was applied. The samples were heated to 1080° C. at a rate of 20° C./min in the same gas mixture and upon reaching the temperature held there for 1, 4 and 16 hours. Cooling was carried out at 50° C./min in the flowing process gas. For all treatment this resulted in carbo-oxidation of the titanium. Mixed interstitial compounds $TiO_xC_{1-x}$ and mixed interstitial solid solutions based on carbon and oxygen ('diffusion zone') formed. The hardness depth profiles are given in FIG. 14, where FIG. 14*a* shows the hardness profile after 1 hour treatment, FIG. 14*b* after 4 hours treatment and FIG. 14*c* after 16 hours treatment; in FIG. 14 the blue symbols illustrate the hardness of the mixed interstitial solid solution and the orange symbols illustrate the hardness of the mixed interstitial compounds. It is seen that the hardness of the mixed interstitial compounds is consistently at least 2000 HV, whereas the hardness of the mixed interstitial solid solution is at least 1000 HV for a depth above 150 μm (for 1 hour treatment) to a depth of up to 500 μm (for 16 hours treatment).

Example 8—Carbo-Oxidation Titanium Grade 2

Figure 15A:
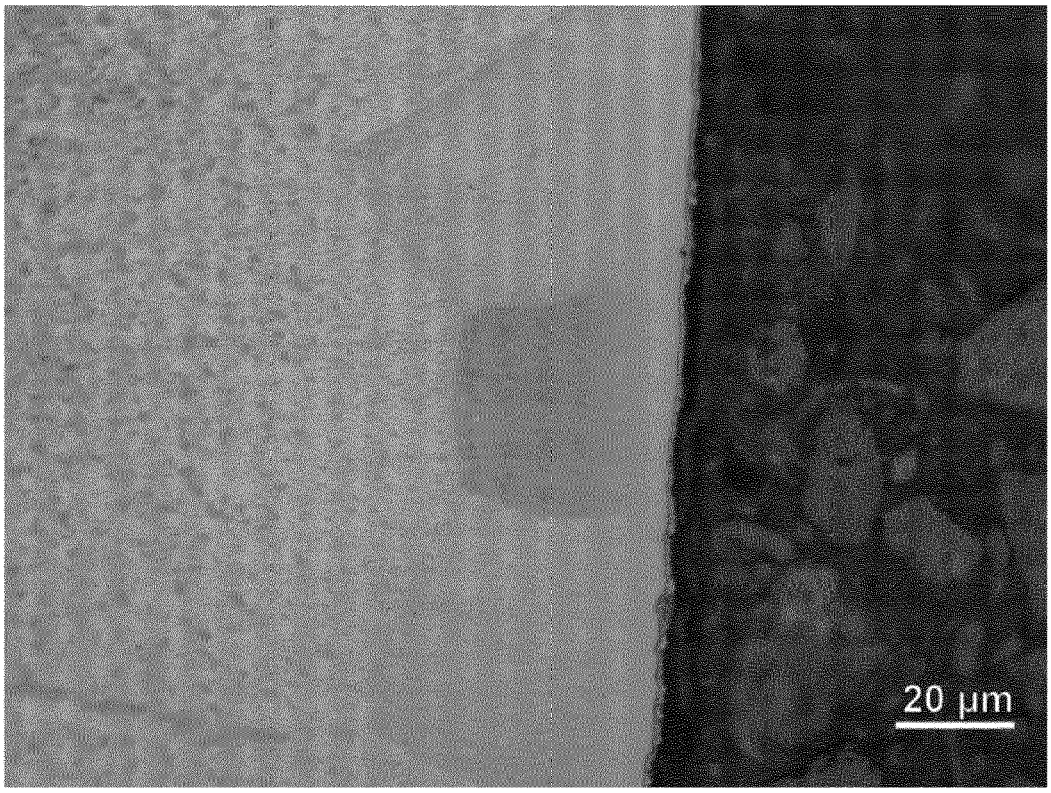
FIG. 15 shows cross-sections of titanium grade 2 hardened with carbon and oxygen in the method of the invention.
Figure 15B:
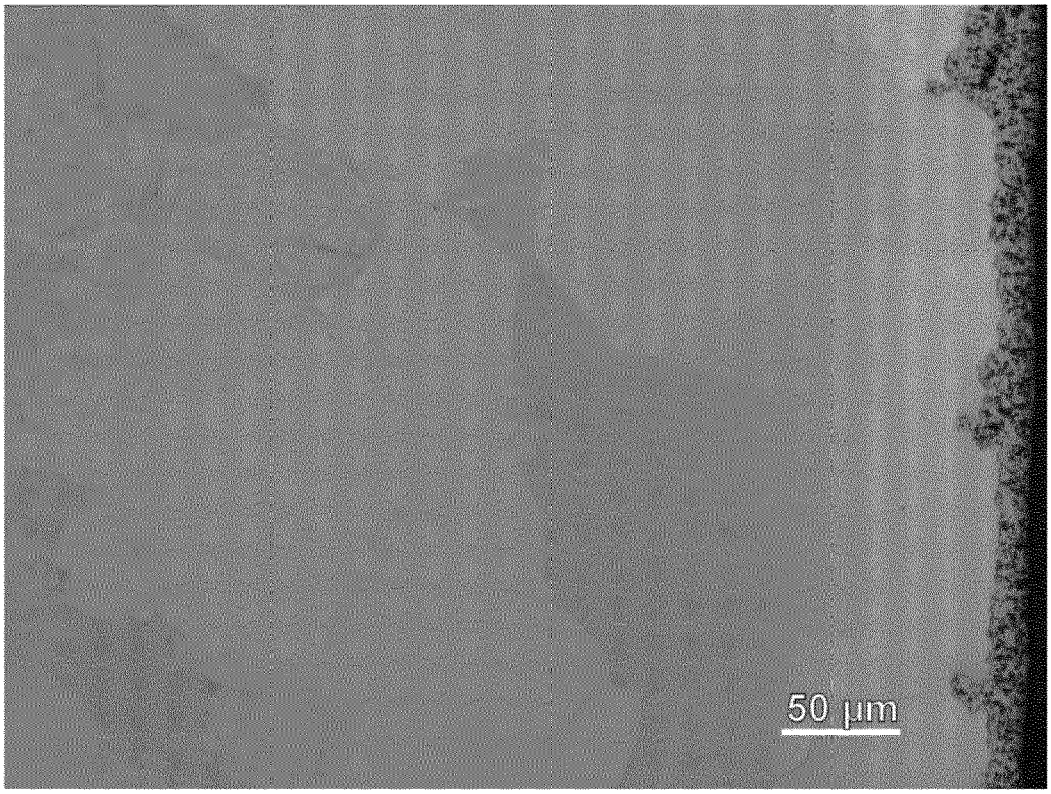
Figure 15C:
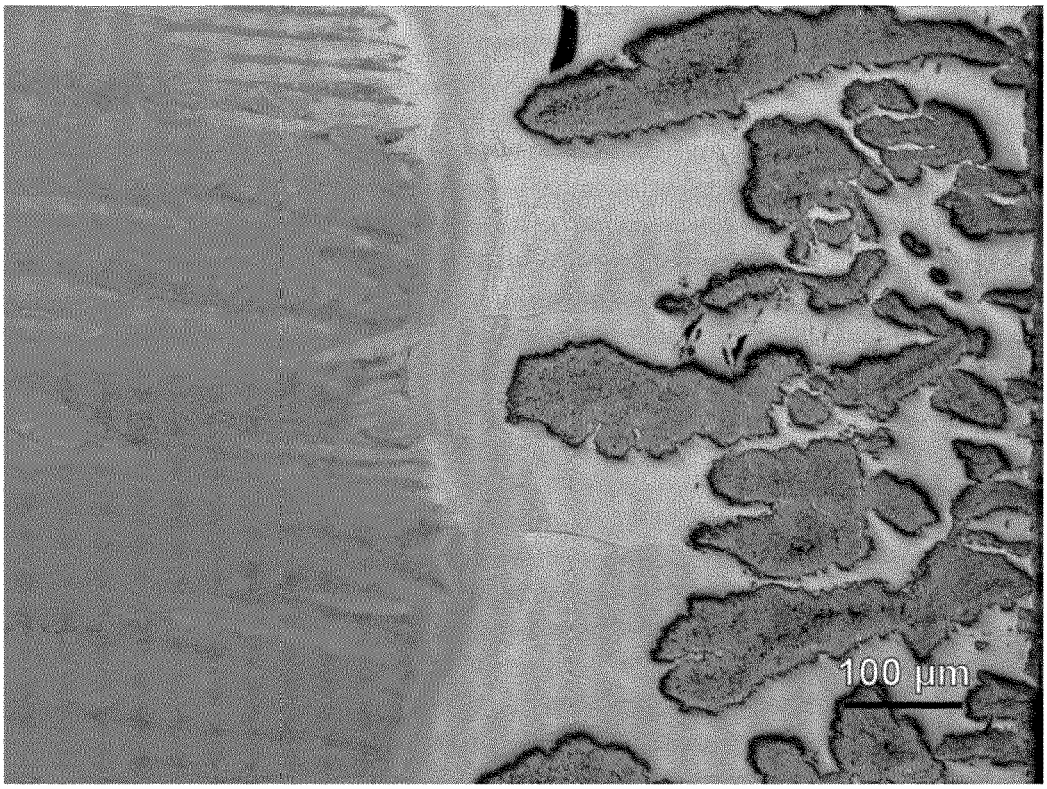

Cylindrical (Ø10 mm) grade 2 titanium sample were treated in a Netzsch 449 Thermal analyzer (furnace). For all experiment, the furnace was evacuated and backfilled with argon gas twice and a continuous gas flow consisting of 10 ml/min Ar and 40 ml/min CO was applied. The samples were heated to different temperatures (840, 920 and 1000° C.) at a rate of 20° C./min in the same gas mixture and upon reaching the temperature held there for 16 hours. Cooling was carried out at 50° C./min in the flowing process gas. For all treatment this resulted in carbo-oxidation of the titanium, as is evident from the reflected light optical microscopy images shown in FIG. 15*a-c*. Different morphologies of the hard case was obtained: at 840° C. a diffusion zone without visible a phase of carbo-oxide compounds was observed (FIG. 15*a*), at 920° C. a compact mixed interstitial compound layer on top of a diffusion zone was formed (FIG. 15*b*), and at 1000° C. the diffusion zone contained large a phase of mixed interstitial compound (FIG. 15*c*). Thus, when the treatment temperature was below 900° C. microhardnesses for the diffusion zone and the carbo-oxide layer could not be measured at the same depth from the surface, whereas when the temperature was increased above 900° C. microhardnesses for the diffusion zone and the carbo-oxide layer could be measured at the same depth from the surface.

Example 9—Carbo-Oxidation

Figure 16:
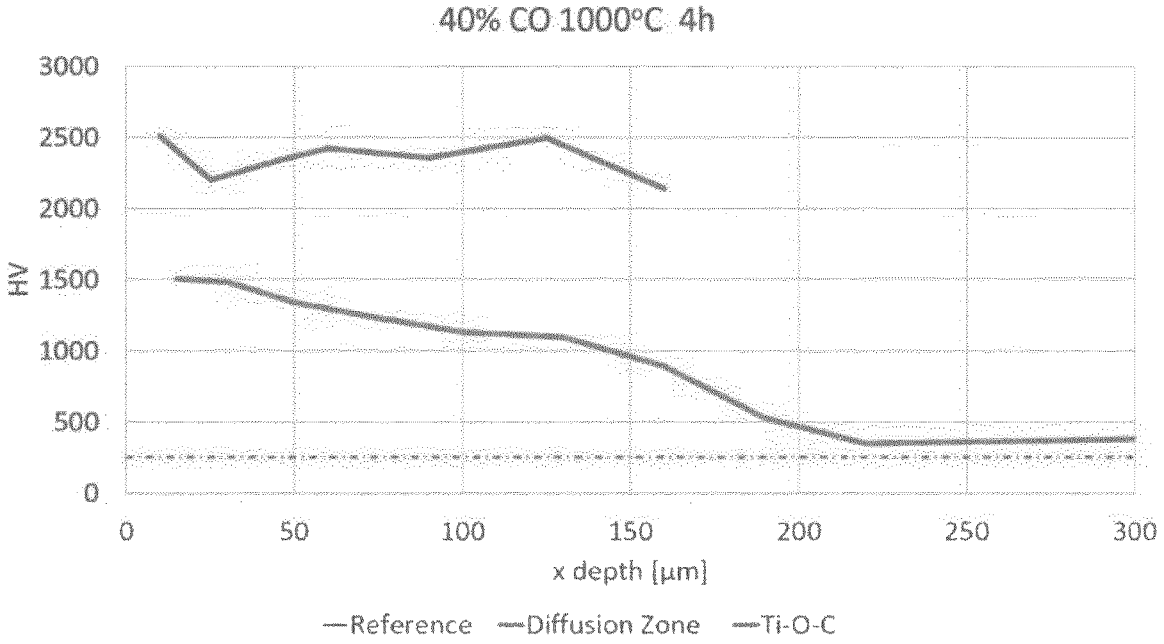
FIG. 16 shows hardness profiles of titanium grade 2 hardened with carbon and oxygen in the method of the invention.

A cylindrical (Ø10 mm) grade 2 titanium sample was treated in a Netzsch 449 Thermal analyzer (furnace). The furnace was evacuated and backfilled with argon gas twice and a continuous gas flow consisting of 30 ml/min Ar and 20 ml/min CO was applied. The sample was heated to 1000° C. at a rate of 20° C./min in the same gas mixture and upon reaching the temperature held there for 4 hours. Cooling was carried out at 50° C./min in the flowing process gas. A mixed interstitial compound $TiO_xC_{1-x}$ and a mixed interstitial solid solution based on carbon and oxygen ('diffusion zone') have formed. The case depth is approximately 200 μm. The hardness profiles of the $TiO_xC_{1-x}$ and the C+O rich diffusion zone are illustrated in FIG. 16, which also shows (as a dotted line) the hardness of the untreated material, which corresponds to the core hardness of the treated material.

Example 10—Carbo-Oxidation

Figure 17A:
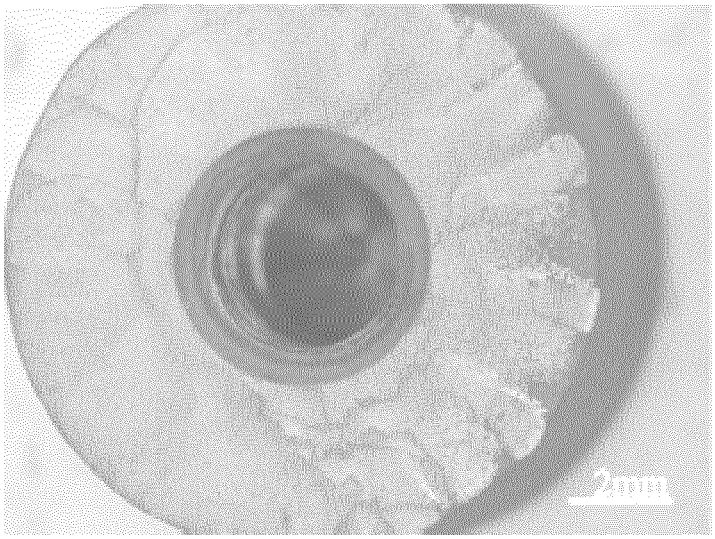
FIG. 17 illustrates corrosion tests of titanium grade 2 hardened with carbon and oxygen in the method of the invention.
Figure 17B:
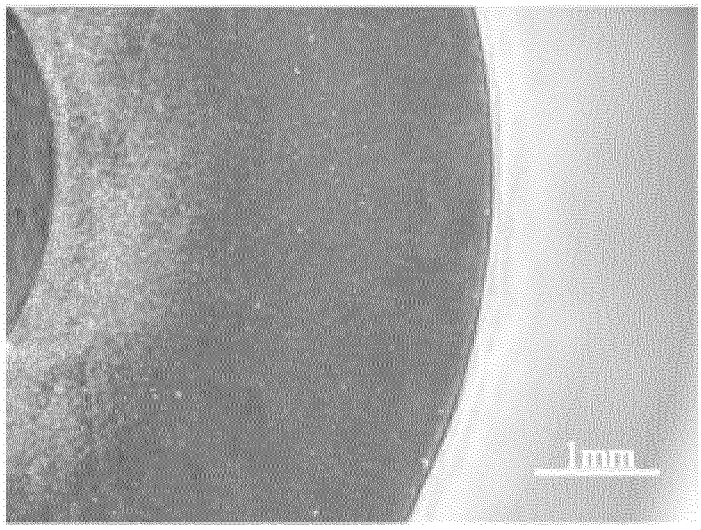

A cylindrical (Ø10 mm) grade 2 titanium sample was treated in a Netzsch 449 Thermal analyzer (furnace). The furnace was evacuated and backfilled with argon gas twice and a continuous gas flow consisting of 10 ml/min Ar and 40 ml/min CO was applied. The sample was heated to 1000° C. at a rate of 20° C./min in the same gas mixture and upon reaching the temperature held there for 4 hours. Cooling was carried out at 50° C./min in the flowing process gas. A mixed interstitial compound $TiO_xC_{1-x}$ and a mixed interstitial solid solution based on carbon and oxygen ('diffusion zone') have formed. The sample was immersed in 0.25 wt % HF with pH adjusted to 1 with HCl; the results after 16 days of treatment are shown in FIG. 17, where FIG. 17*a* shows that the untreated reference suffered from corrosion upon exposure to the solution, whereas no signs of corrosion for the sample hardened according to the invention were observed after 16 days (FIG. 17*b*). The sample not hardened according to the invention showed signs of corrosion immediately upon exposure to HF as evidenced by discoloration of the solution in which the sample was placed.

Example 11—Carbo-Oxidation

Figure 18:
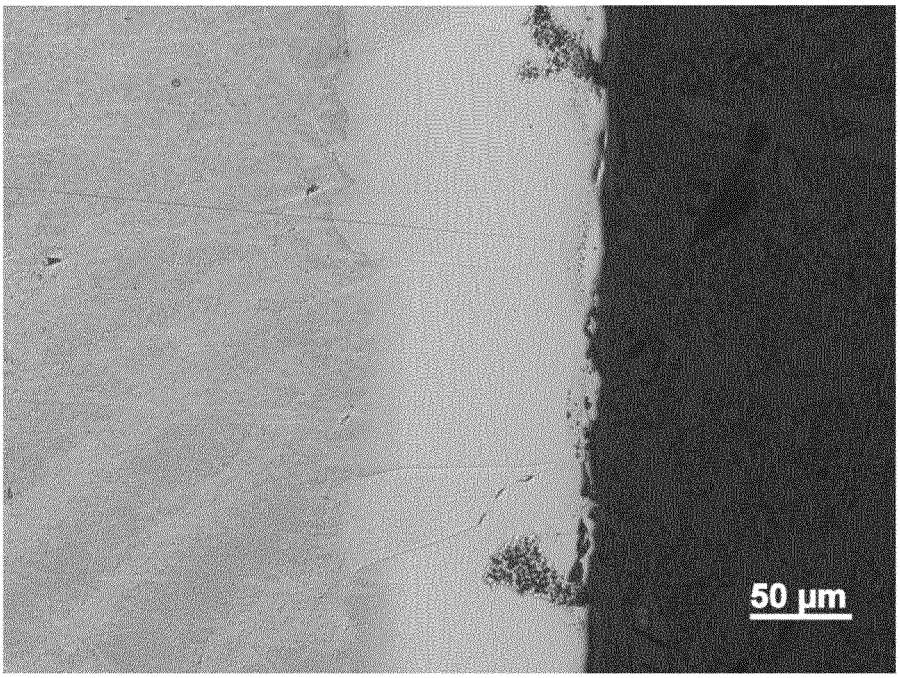
FIG. 18 shows a cross-section of titanium grade 2 hardened with carbon and oxygen in the method of the invention.

A cylindrical (Ø10 mm) grade 2 titanium sample was treated in a Netzsch 449 Thermal analyzer (furnace). The furnace was evacuated and backfilled with argon gas twice and a continuous gas flow consisting of 10 ml/min Ar, 35 ml/min CO and 5 ml/min $CO_2$ was applied. The sample was heated to 1000° C. at a rate of 20° C./min in the same gas mixture and upon reaching the temperature held there for 4 hours. Cooling was carried out at 50° C./min in the flowing process gas. The presence of $CO_2$ increases the partial pressure of $O_2$ and lowers the carbon activity. The result is illustrated in FIG. 18. A mixed interstitial compound $TiO_xC_{1-x}$ and a mixed interstitial solid solution based on carbon and oxygen ('diffusion zone') have formed. The diffusion zone is now the dominant feature. The case depth is approximately 120 μm.

Example 12—Oxidation of Titanium Grade 2 in $CO/CO_2$

Figure 19:
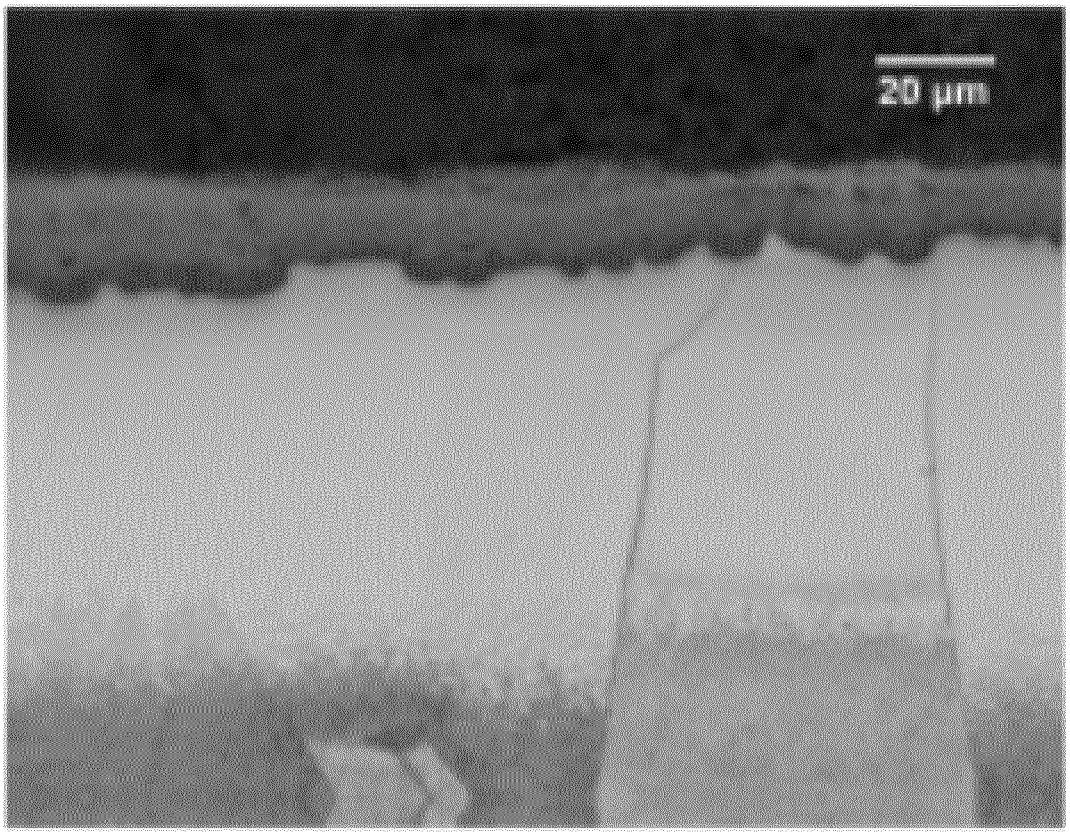
FIG. 19 shows a cross-section of titanium grade 2 oxidised in the method of the invention.

A cylindrical (Ø10 mm) grade 2 titanium sample was treated in a Netzsch 449 Thermal analyzer (furnace). The furnace was evacuated and backfilled with argon gas twice and a continuous gas flow consisting of 10 ml/min Ar, 30 ml/min $CO_2$ and 20 ml/min CO was applied ($pCO$=0.33 atm and $pCO_2$=0.50 atm). The sample was heated to 1000° C. at a rate of 20° C./min in the same gas mixture and upon reaching the temperature held there for 20 hours. Cooling was carried out at 50° C./min in the flowing process gas. The applied gas resulted in oxidation of the titanium, as shown in FIG. 19, which shows a layer of titanium oxide of a thickness of about 25 μm and a diffusion layer of oxygen in solid solution in titanium (below the oxide layer)—the diffusion layer had a thickness of about 100 μm thickness.

Figure 20:
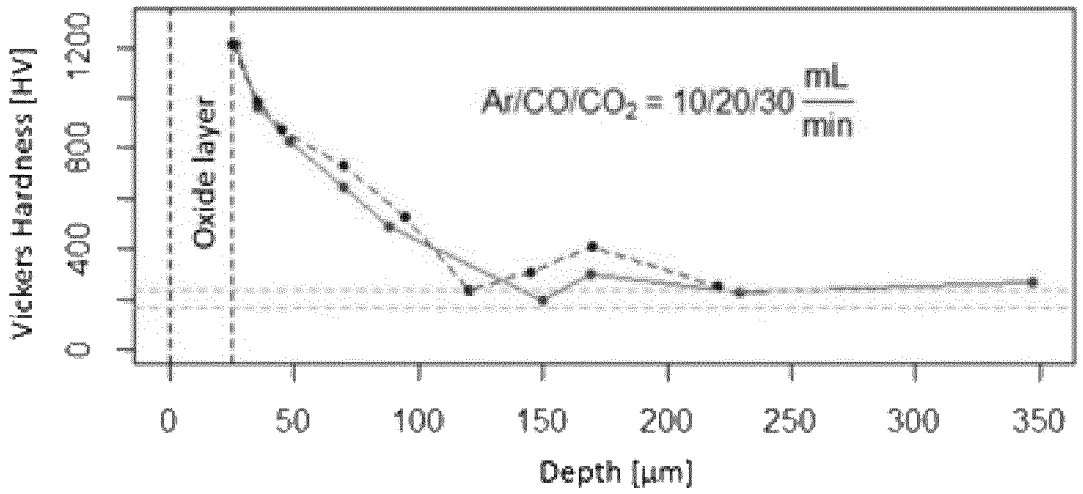
FIG. 20 shows hardness profiles of a titanium grade 2 oxidised in the method of the invention.

The hardness profiles of the treated samples were recorded and these are illustrated in FIG. 20. The dotted horizontal lines illustrate the core hardness of the titanium metal.

Example 13—Oxidation of Titanium Grade 2 in $CO/CO_2$

Figure 21:
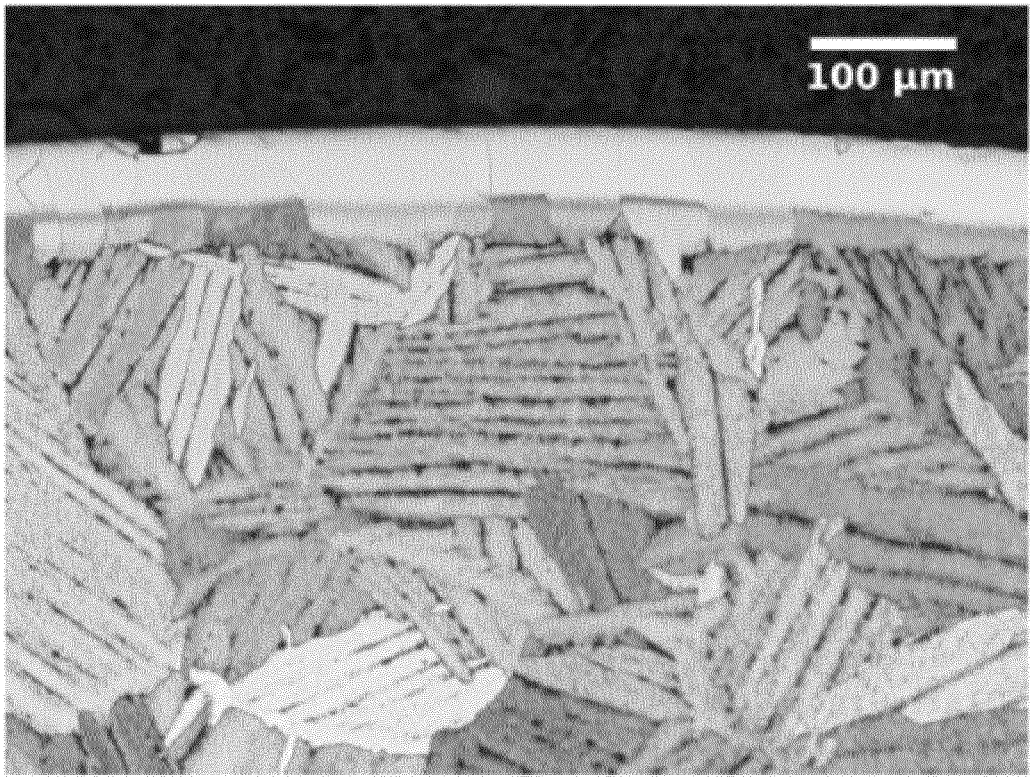
FIG. 21 shows a cross-section of titanium grade 2 oxidised in the method of the invention.

A cylindrical (Ø10 mm) grade 2 titanium sample was treated in a Netzsch 449 Thermal analyzer (furnace). The furnace was evacuated and backfilled with argon gas twice and a continuous gas flow consisting of 10 ml/min Ar, 10 ml/min $CO_2$ and 40 ml/min CO was applied. The sample was heated to 1000° C. at a rate of 20° C./min in the same gas mixture and upon reaching the temperature held there for 20 hours. Cooling was carried out at 50° C./min in the flowing process gas. The applied gas resulted in oxidation of the titanium represented as a zone of oxygen in solid solution ('diffusion zone') as shown in FIG. 21.

Example 14—Oxidation Titanium Grade 2

A cylindrical (Ø10 mm) grade 2 titanium sample was treated in a Netzsch 449 Thermal analyzer (furnace). The furnace was evacuated and backfilled with argon gas twice and a continuous gas flow consisting of 10 ml/min Ar, 10 ml/min CO and 40 ml/min $CO_2$ was applied. The sample was heated to 750° C. at a rate of 20° C./min in the same gas mixture and upon reaching the temperature held there for 20 hours. Cooling was carried out at 50° C./min in the flowing process gas. The applied gas mixture resulted in oxidation of the titanium providing an oxide layer and a diffusion zone below the oxide layer of a total thickness of about 20 μm.

Example 15—'3-interstitial' Component Processing

Figure 22:
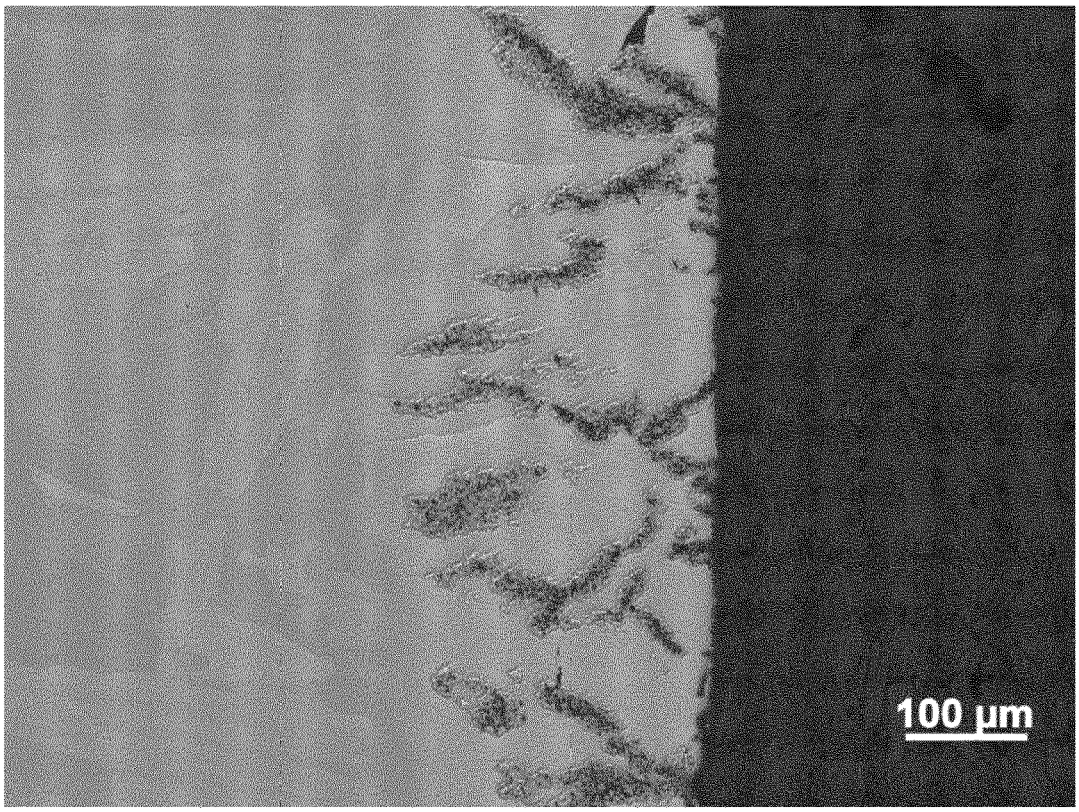
FIG. 22 shows a cross-section of titanium grade 2 treated in the duplex hardening method of the invention.
Figure 23:
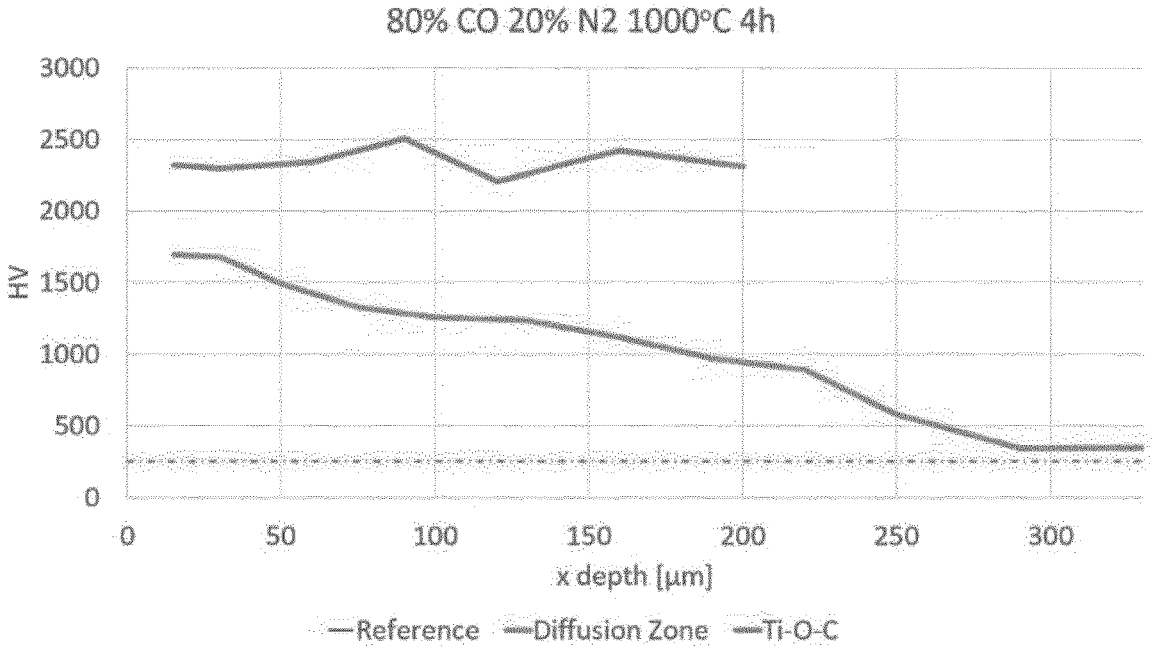
FIG. 23 shows hardness profiles of titanium grade 2 hardened in the duplex method of the invention.

A cylindrical (Ø10 mm) grade 2 titanium sample was treated in a Netzsch 449 Thermal analyzer (furnace). The furnace was evacuated and backfilled with nitrogen gas twice and a continuous gas flow consisting of 10 ml/min $N_2$ and 40 ml/min CO was applied. The applied gas-mixture contains the interstitial elements N, C and O. The sample was heated to 1000° C. at a rate of 20° C./min in the same gas mixture and upon reaching the temperature held there for 4 hours. Cooling was carried out at 50° C./min in the flowing process gas. This resulted in "carbo-nitro-oxidation"

of the titanium as shown in FIG. 22. A mixed interstitial compound $TiO_xN_yC_{1-x-y}$ and a mixed interstitial solid solution based on carbon, oxygen and nitrogen ('diffusion zone') have formed. The surface appearance had a slightly more "goldish" appearance than pure carbo-oxidation. The hardness profiles of the mixed interstitial compound $TiO_xN_yC_{1-x-y}$ and the diffusion zone are illustrated in FIG. 23, which also shows (as a dotted line) the hardness of the untreated material, which corresponds to the core hardness of the treated material. The case thickness is approximately 220 μm.

Figure 24:
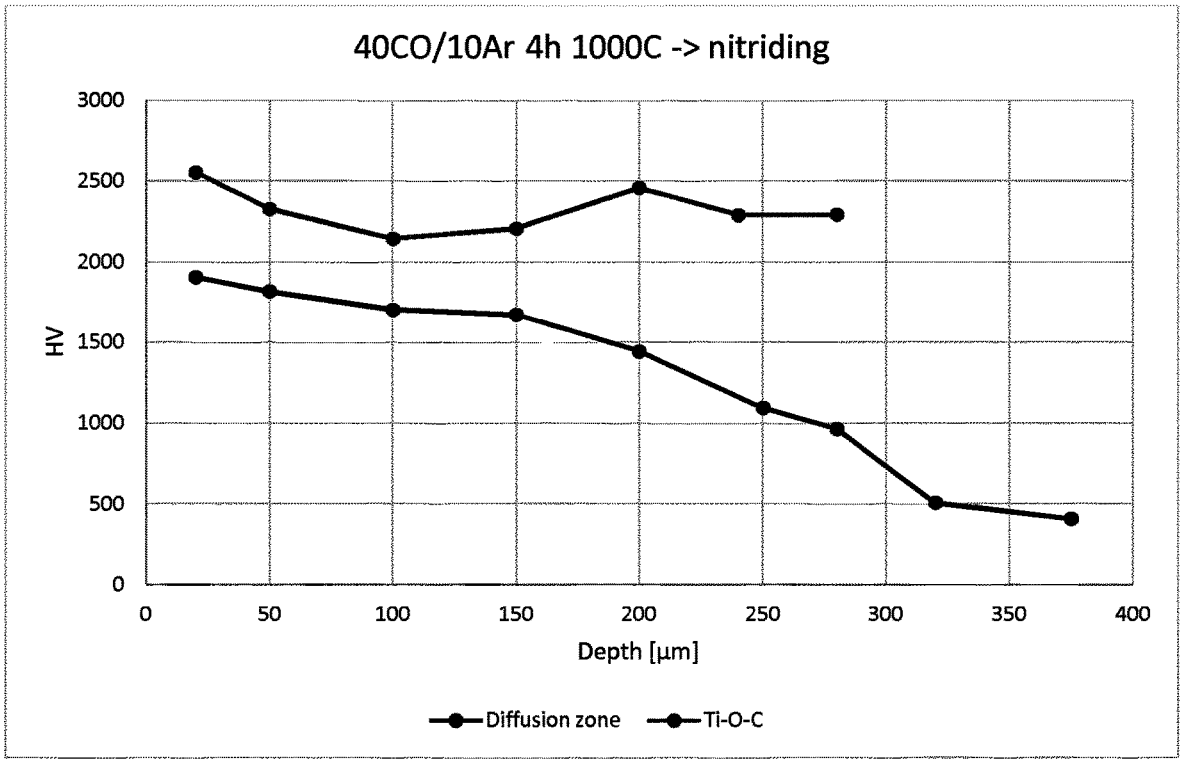
FIG. 24 shows a hardness profile of a titanium grade 2 treated in the duplex hardening method of the invention.

Example 16—Duplex Processing of Titanium Grade 2; Carbo-Oxidation Followed by Nitriding A cylindrical (Ø10 mm) grade 2 titanium sample was treated in a Netzsch 449 Thermal analyzer (furnace). The furnace was evacuated and backfilled with argon gas twice and a continuous gas flow consisting of 10 ml/min Ar and 40 ml/min CO was applied. The sample was heated to 1000° C. at a rate of 20° C./min in the same gas mixture and upon reaching the temperature held there for 4 hours. Cooling was carried out at 50° C./min in the flowing process gas. This resulted in carbo-oxidation of the titanium. The carbo-oxidized component was subsequently treated in a tube-furnace equipped with pure $N_2$ gas. Nitriding was carried out at 1000° C. for 1 hour in flowing $N_2$ gas (1 l/min). This resulted in partial conversion the C—O-rich surface case into a C—O—N containing surface. The diffusion zone is now significantly harder as illustrated in the hardness profile presented in FIG. 24.

Figure 25:
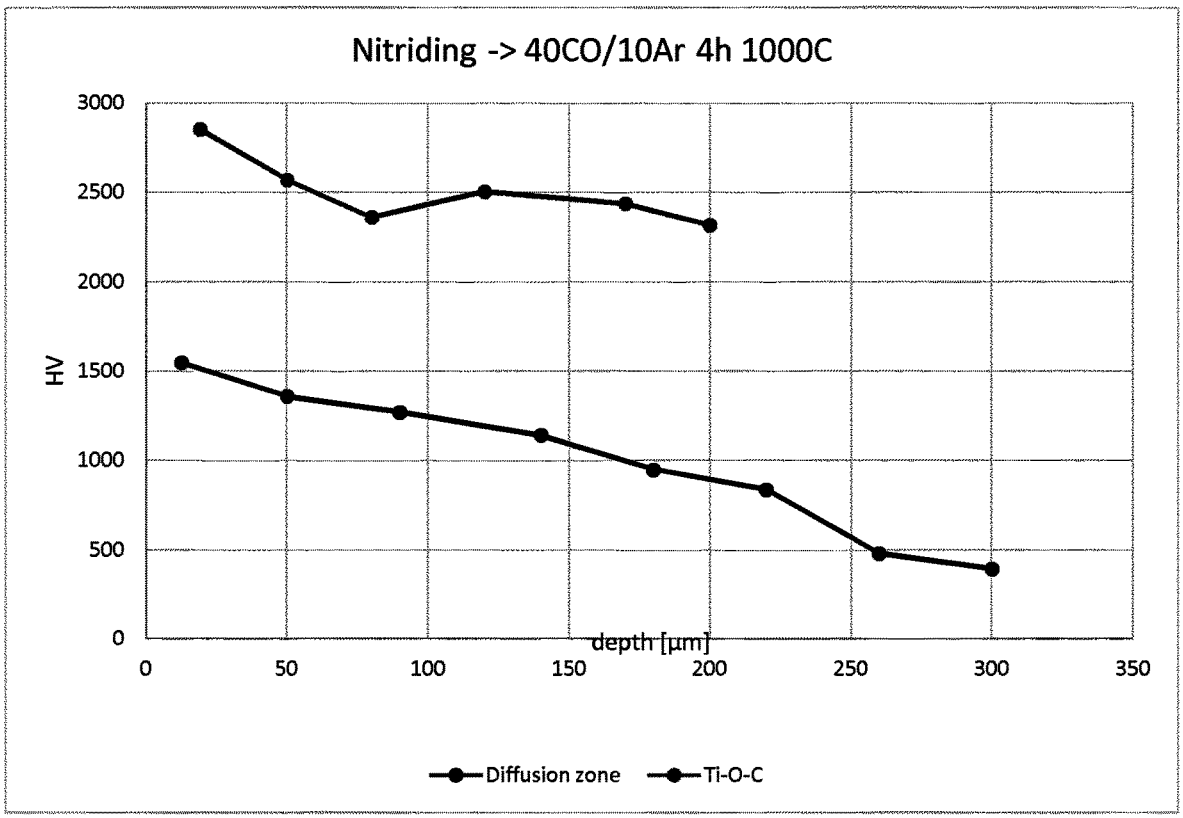
FIG. 25 shows a hardness profile of a titanium grade 2 treated in the duplex hardening method of the invention.

Example 17—Duplex Processing of Titanium Grade 2; Nitriding Followed by Carbo-Oxidation A cylindrical (Ø10 mm) grade 2 titanium sample was nitrided in a tube furnace at 1000° C. for 1 hour in flowing $N_2$ gas (1 l/min). This resulted in a surface layer of TiN. The nitrided component was subsequently treated in a Netzsch 449 Thermal analyzer (furnace). The furnace was evacuated and backfilled with argon gas twice and a continuous gas flow consisting of 10 ml/min Ar and 40 ml/min CO was applied (carbo-oxidation). The sample was heated to 1000° C. at a rate of 20° C./min in the same gas mixture and upon reaching the temperature held there for 4 hours. Cooling was carried out at 50° C./min in the flowing process gas. This resulted in (partial) conversion the N-rich surface case into a C—O—N containing surface. The hardness profile is shown in FIG. 25.

Example 18—Zirconium Carbo-Oxidation

A zirconium sample was treated in a Netzsch 449 Thermal analyzer (furnace). The furnace was evacuated and backfilled with argon gas twice and a continuous gas flow consisting of 10 ml/min Ar and 40 ml/min CO was applied. The sample was heated to 1000° C. at a rate of 20° C./min in the same gas mixture and upon reaching the temperature held there for 1 hour. Cooling was carried out at 50° C./min in the flowing process gas. This resulted in carbo-oxidation of the zirconium. The surface hardness was 800 HV.

Example 19—Formation of Magnéli Phases

Figure 26:
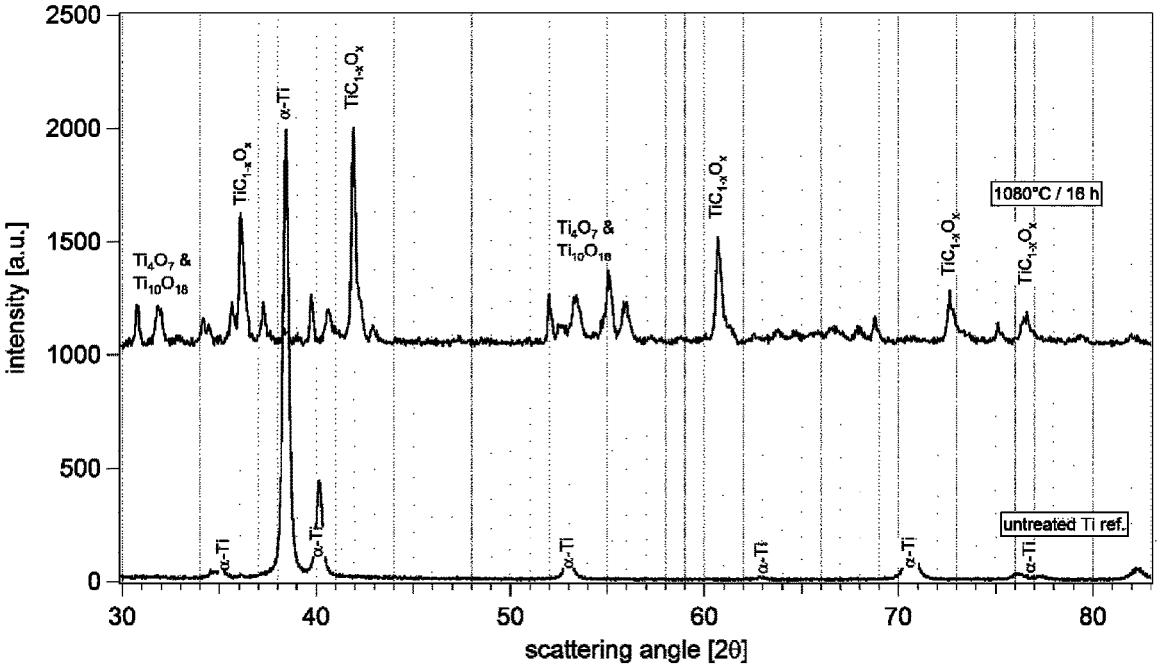
FIG. 26 shows an X-ray diffraction analysis of a sample of titanium grade 2 hardened according to the invention.
Figure 27:
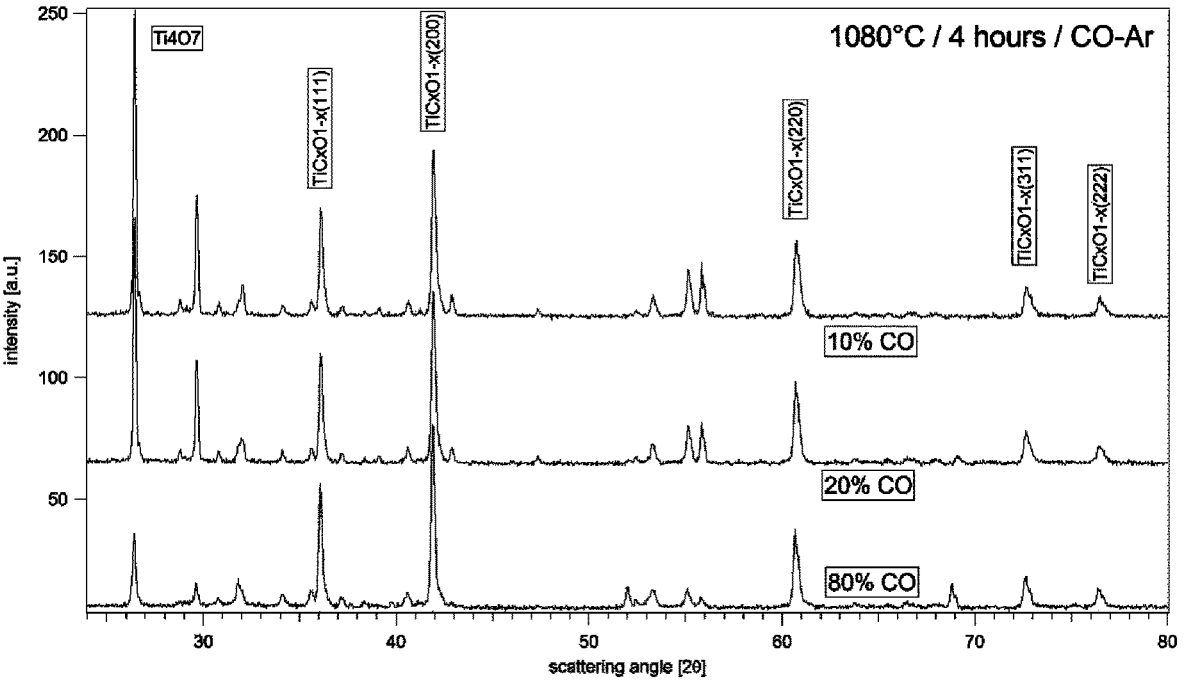
FIG. 27 shows X-ray diffraction analyses of samples of titanium grade 2 hardened according to the invention.

The grade 2 titanium sample hardened for 16 hours in Example 7 was analysed for the presence of a Magnéli phase using X-ray diffraction. The X-ray diffraction pattern is illustrated in FIG. 26, where it is compared to the X-ray diffraction pattern of untreated titanium. FIG. 26 shows the formation of titanium suboxides also known as Magnéli phases. The hardening in Example 7 was performed at 80% CO in argon. The hardening was repeated using reactive durations of 4 hours with 10%, 20% and 80% CO in argon, respectively, and the hardened samples were subjected to X-ray diffraction analysis. The results are shown in FIG. 27, which shows that by decreasing the partial pressure of CO the amount of $Ti_4O_7$ increases in the Magnéli phases.

The invention claimed is:

1. A method of producing a case hardened component of a titanium alloy, the method comprising the steps of:

providing a component of a titanium alloy, placing the component in a reactive atmosphere comprising a carbon providing gaseous species at a partial pressure of at least $10^{-5}$ bar, the carbon providing gaseous species containing carbon and oxygen, and which reactive atmosphere does not comprise a hydrogen containing species, heating the component in an inert atmosphere or the reactive atmosphere to a dissolution temperature $T_D$ of at least 800° C., maintaining the component in the reactive atmosphere at $T_D$ for a reactive duration of at least 30 min to provide the component with a diffusion zone comprising carbon and oxygen in solid solution and having a distinct phase of a carbo-oxide compound having the composition $TiO_xC_{1-x}$, wherein x is a number in the range of 0.01 to 0.99, which diffusion zone has a microhardness of at least 800 $HV_{0.025}$ and which carbo-oxide compound has a microhardness of at least 1200 $HV_{0.025}$, the diffusion zone having a thickness of at least 10 μm, cooling the component from $T_D$ to ambient temperature.

2. The method according to claim 1, wherein the carbon providing gaseous species is CO or CO and $CO_2$ at a ratio of CO to $CO_2$ of at least 5.

3. The method according to claim 1, wherein $T_D$ is at least 900° C. and wherein the partial pressure of the carbon providing gaseous species is at least 0.1 bar.

4. The method of producing a case hardened component according to claim 1, wherein the reactive atmosphere further comprises a nitrogen containing species.

5. The method of producing a case hardened component according to claim 1, wherein the method further comprises the steps of:

placing the component in a nitriding atmosphere comprising a nitriding gaseous species at a partial pressure of at least $10^{-5}$ bar, maintaining the component in the nitriding atmosphere at a nitriding temperature $T_N$ of at least 800° C. for a nitriding duration of at least 5 min to diffuse nitrogen into the component.

6. A method of oxidising a component of a Group IV metal, the method comprising the steps of:

providing a component of a Group IV metal, placing the component in an oxidising atmosphere comprising an oxidising gaseous species selected from the list consisting of $CO_2$, mixtures of CO and $CO_2$, $H_2O$ and mixtures of $H_2O$ and $H_2$, or mixtures thereof, wherein the oxidising gaseous species is selected to provide a partial pressure of $O_2$ of less than 0.1 bar, heating the component in an inert atmosphere or the oxidising atmosphere to an oxidising temperature $T_{Ox}$ of at least 600° C., maintaining the component in the oxidising atmosphere at $T_{Ox}$ for a reactive duration of at least 5 min to dissolve oxygen in the component, cooling the component from $T_{Ox}$ to ambient temperature.

7. The method of oxidising a component of a Group IV metal according to claim 6, wherein the oxidising atmosphere does not comprise a reactive amount of a nitrogen containing species and/or wherein the oxidising atmosphere is not supplemented with $O_2$.

8. The method of oxidising a component of a Group IV metal according to claim 6, wherein the oxidising atmosphere consists of the oxidising gaseous species, or wherein the oxidising atmosphere consists of an inert gas and the oxidising gaseous species and the total pressure of the oxidising atmosphere is in the range of 0.5 bar to 5 bar.

9. The method of oxidising a component of a Group IV metal according to claim 6, wherein the Group IV metal is selected from the list consisting of titanium, a titanium alloy, zirconium and a zirconium alloy.

10. The method of oxidising a component of a Group IV metal according to claim 6, wherein a Magnéli phase is formed on the surface of the Group IV metal.

* * * * *